US010668723B2

(12) United States Patent
Hozumi

(10) Patent No.: US 10,668,723 B2
(45) Date of Patent: Jun. 2, 2020

(54) LIQUID EJECTION HEAD AND RECORDING APPARATUS

(71) Applicant: KYOCERA Corporation, Kyoto-shi, Kyoto (JP)

(72) Inventor: Daisuke Hozumi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 16/334,785

(22) PCT Filed: Sep. 20, 2017

(86) PCT No.: PCT/JP2017/033833
§ 371 (c)(1),
(2) Date: Mar. 20, 2019

(87) PCT Pub. No.: WO2018/056290
PCT Pub. Date: Mar. 29, 2018

(65) Prior Publication Data

US 2019/0232654 A1 Aug. 1, 2019

(30) Foreign Application Priority Data

Sep. 20, 2016 (JP) ..... 2016-182998

(51) Int. Cl.
*B41J 2/14* (2006.01)
*B41J 2/155* (2006.01)
*B41J 2/18* (2006.01)

(52) U.S. Cl.
CPC ..... *B41J 2/14201* (2013.01); *B41J 2/14209* (2013.01); *B41J 2/155* (2013.01);
(Continued)

(58) Field of Classification Search
CPC ..... B41J 2/14; B41J 2/17513; B41J 2002/14419; B41J 2/04581; B41J 2/04588; B41J 2/14201
(Continued)

(56) References Cited

U.S. PATENT DOCUMENTS 7,976,139 B2 * 7/2011 Kyoso ..... B41J 2/14233 347/85
9,233,545 B2 * 1/2016 Kamo ..... B41J 2/175
(Continued)

FOREIGN PATENT DOCUMENTS

JP 2008-200902 A 9/2008

*Primary Examiner* — An H Do
(74) *Attorney, Agent, or Firm* — Volpe and Koenig, P.C.

(57) ABSTRACT

A liquid ejection head includes a plurality of pressurizing chambers connected to a plurality of ejection holes, a plurality of first individual flow paths connected to the plurality of pressurizing chambers, a plurality of second individual flow paths and a plurality of third individual flow paths, a first common flow path is connected in common to the plurality of first and second individual flow paths, and a second common flow path is connected in common to the plurality of third individual flow paths. The first and second individual flow paths are connected to the same pressurizing chamber, the first individual flow path is connected to the first common flow path on a side of an opening end portion, compared to the second individual flow path. The first individual flow path is located opposite to a side where the ejection hole is open outward, compared to the second individual flow path.

8 Claims, 11 Drawing Sheets

(52) U.S. Cl.
CPC ..... *B41J 2/18* (2013.01); *B41J 2002/14225* (2013.01); *B41J 2002/14362* (2013.01); *B41J 2002/14419* (2013.01); *B41J 2002/14459* (2013.01); *B41J 2002/14467* (2013.01); *B41J 2202/12* (2013.01)

(58) Field of Classification Search
USPC ..... 347/20, 40, 44, 54, 63, 68, 71
See application file for complete search history.

(56) References Cited

U.S. PATENT DOCUMENTS

| | | | | |
|---|---|---|---|---|
| 2008/0198208 | A1 | 8/2008 | Kyoso et al. | |
| 2009/0309917 | A1* | 12/2009 | Inada | B41J 2/16532 347/30 |
| 2015/0239243 | A1* | 8/2015 | Muraoka | B41J 2/1433 347/47 |

* cited by examiner

LIQUID EJECTION HEAD AND RECORDING APPARATUS

TECHNICAL FIELD

This disclosure relates to a liquid ejection head and a recording apparatus.

BACKGROUND ART

For example, in the related art, a liquid ejection head is known as a printing head which performs printing in various ways by ejecting a liquid onto a recording medium. For example, the liquid ejection head includes a common flow path through which a liquid flows and a plurality of ejection units connected to the common flow path. For example, each of the ejection units has an ejection hole, a pressurizing chamber connected to the ejection hole, and an individual flow path which connects the pressurizing chamber and the common flow path to each other. The pressurizing chamber is pressurized, thereby ejecting the liquid from the ejection hole. According to PTL 1, in each of the ejection units, the pressurizing chamber and the common flow path are connected to each other using two individual flow paths. One of the two individual flow paths is used in order to supply the liquid to the pressurizing chamber, and the other is used in order to collect the liquid from the pressurizing chamber.

CITATION LIST

Patent Literature

PTL 1: Japanese Unexamined Patent Application Publication No. 2008-200902

SUMMARY OF INVENTION

A liquid ejection head according to an aspect of this disclosure includes a flow path member and a pressurizing unit. The flow path member includes a plurality of ejection holes, a plurality of pressurizing chambers respectively connected to the plurality of ejection holes, a plurality of first flow paths respectively connected to the plurality of pressurizing chambers, a plurality of second flow paths respectively connected to the plurality of pressurizing chambers, a plurality of third flow paths respectively connected to the plurality of pressurizing chambers, a fourth flow path that extends in a direction perpendicular to an opening direction of the plurality of ejection holes from a first end portion which is open to a second end portion which is closed or whose opening area is smaller than an opening area of the first end portion, and that is connected in common to the plurality of first flow paths and the plurality of second flow paths between the first end portion and the second end portion, and a fifth flow path that is connected in common to the plurality of third flow paths. Pressurizing units respectively pressurize a liquid inside the plurality of pressurizing chambers. In the first flow path and the second flow path which are connected to an identical one of the pressurizing chambers, a connection position between the first flow path and the fourth flow path is located on a side of the first end portion, compared to a connection position between the second flow path and the fourth flow path. The connection position between the first flow path and the fourth flow path is located opposite to a side where the ejection hole is open outward, compared to the connection position between the second flow path and the fourth flow path.

A recording apparatus according to another aspect of this disclosure includes the liquid ejection head, a transport unit that transports a recording medium to the liquid ejection head, and a control unit that controls the liquid ejection head.

BRIEF DESCRIPTION OF DRAWINGS

FIG. 10 illustrates a liquid ejection head according to a second embodiment.

FIG. 11 illustrates a liquid ejection head according to a third embodiment.

DESCRIPTION OF EMBODIMENTS

Figure 1A:
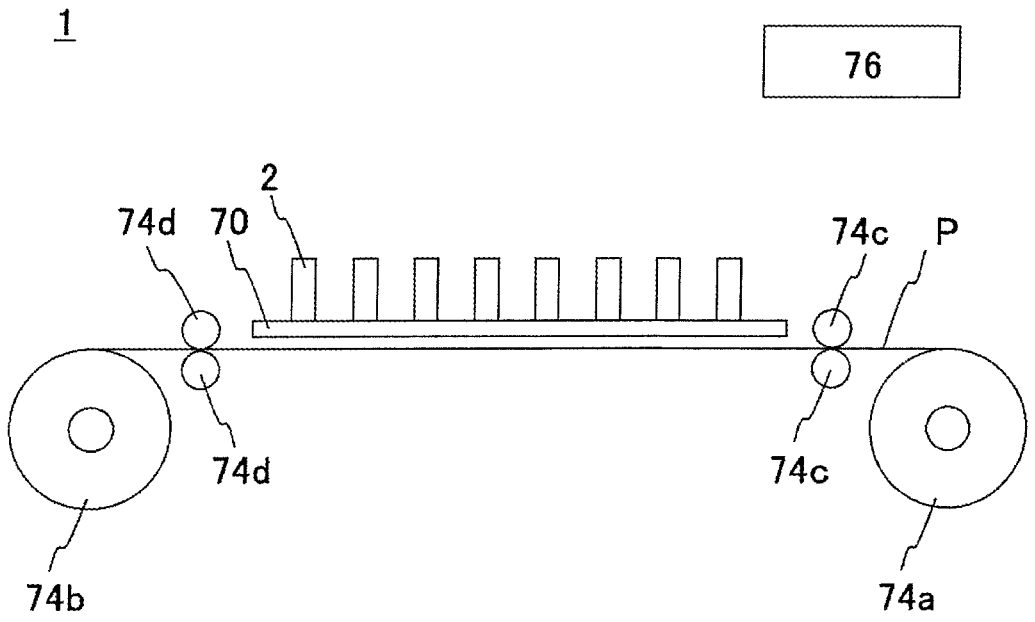
FIG. 1A is a side view schematically illustrating a recording apparatus including a liquid ejection head according to a first embodiment.

Hereinafter, embodiments according to this disclosure will be described with reference to the drawings. The drawings used in the following description are schematically illustrated, and dimensional ratios on the drawings do not necessarily coincide with actual ratios. Even in a plurality of drawings illustrating the same member, in some cases, the dimensional ratios may not coincide with each other in order to exaggeratingly illustrate a shape thereof.

Subsequently to a second embodiment, reference numerals given to configurations according to the previously described embodiment will be given to configurations which are the same as or similar to the configurations according to the previously described embodiment, and description thereof may be omitted in some cases. Even when reference numerals different from those of the configurations according to the previously described embodiment are given to configurations corresponding (similar) to the configurations according to the previously described embodiment, items which are not particularly specified are the same as those of the configurations according to the previously described embodiment.

First Embodiment (Overall Configuration of Printer)

Referring to FIG. 1, a color inkjet printer 1 (hereinafter, referred to as a printer 1) including a liquid ejection head 2 according to a first embodiment will be described.

The printer 1 moves a recording medium P relative to the liquid ejection head 2 by transporting the recording medium P from a transport roller 74*a* to a transport roller 74*b*. A control unit 76 controls the liquid ejection head 2, based on image or character data. In this manner, a liquid is ejected toward the recording medium P, a droplet is caused to land on the recording medium P, and printing is performed on the recording medium P.

In the present embodiment, the liquid ejection head 2 is fixed to the printer 1, and the printer 1 is a so-called line printer. Another embodiment of a recording apparatus is a so-called serial printer.

A flat plate-shaped head mounting frame 70 is fixed to the printer 1 so as to be substantially parallel to the recording medium P. Twenty holes (not illustrated) are disposed in the head mounting frame 70, and twenty liquid ejection heads 2 are mounted on the respective holes. The five liquid ejection heads 2 configure one head group 72, and the printer 1 has four head groups 72.

Figure 1B:
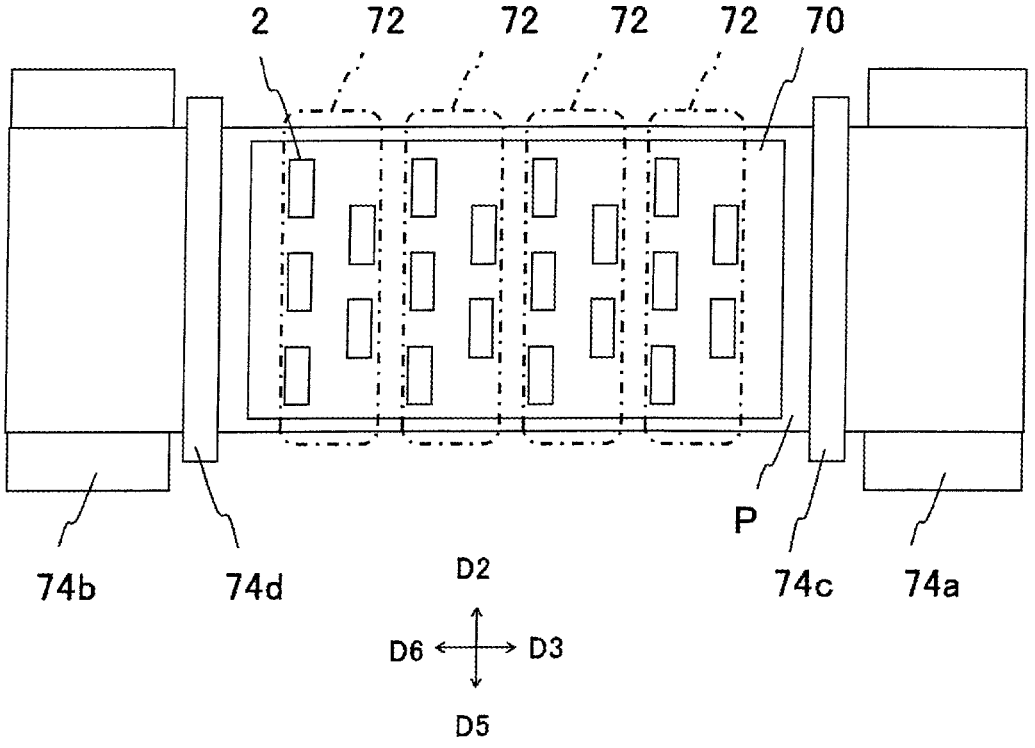
FIG. 1B is a plan view schematically illustrating the recording apparatus including the liquid ejection head according to the first embodiment.

The liquid ejection head 2 has an elongated shape as illustrated in FIG. 1B. Inside one head group 72, the three liquid ejection heads 2 are arrayed along a direction intersecting a transport direction of the recording medium P, the other two liquid ejection heads 2 are respectively arrayed one by one at positions shifted from each other along the transport direction among the three liquid ejection heads 2. The liquid ejection heads 2 adjacent to each other are arranged so that respective printable ranges of the liquid ejection heads 2 are linked to each other in a width direction of the recording medium P or respective edges overlap each other. Accordingly, it is possible to perform printing with no gap in the width direction of the recording medium P.

The four head groups 72 are arranged along the transport direction of the recording medium P. An ink is supplied from a liquid tank (not illustrated) to the respective liquid ejection heads 2. The same color ink is supplied to the liquid ejection heads 2 belonging to one head group 72, and the four head groups perform the printing using four color inks. For example, colors of the ink ejected from the respective head groups 72 are magenta (M), yellow (Y), cyan (C), and black (K).

The number of the liquid ejection heads 2 mounted on the printer 1 may be one as long as a printable range is printed using a single color and one liquid ejection head 2. The number of the liquid ejection heads 2 included in the head group 72 or the number of the head groups 72 can be appropriately changed depending on a printing target or a printing condition. For example, the number of the head groups 72 may be increased in order to further perform multicolor printing. Printing speed, that is, transport speed can be quickened by arranging the plurality of head groups 72 for performing the same color printing and alternately perform the printing in the transport direction. Alternatively, the plurality of head groups 72 for performing the same color printing may be prepared, and the head groups 72 may be arranged shifted from each other in a direction intersecting the transport direction. In this manner, resolution of the recording medium P in the width direction may be improved.

Furthermore, in addition to the color ink printing, a liquid such as a coating agent may be used in the printing in order to perform surface treatment on the recording medium P.

The printer 1 performs the printing on the recording medium P. The recording medium P is in a state of being wound around the transport roller 74*a*, and passes between two transport rollers 74*c*. Thereafter, the recording medium P passes through a lower side of the liquid ejection head 2 mounted on a head mounting frame 70. Thereafter, the recording medium P passes between two transport rollers 74*d*, and is finally collected by the transport roller 74*b*.

As the recording medium P, in addition to printing paper, cloth may be used. The printer 1 may adopt a form of transporting a transport belt instead of the recording medium P. In addition to a roll-type medium, the recording medium may be a sheet, cut cloth, wood or a tile placed on the transport belt. Furthermore, a wiring pattern of an electronic device may be printed by causing the liquid ejection head 2 to eject a liquid including conductive particles. Furthermore, chemicals may be prepared through a reaction process by causing the liquid ejection head 2 to eject a predetermined amount of a liquid chemical agent or a liquid containing the chemical agent toward a reaction container.

A position sensor, a speed sensor, or a temperature sensor may be attached to the printer 1, and the control unit 76 may control each unit of the printer 1 in accordance with a state of each unit of the printer 1 which is recognized based on information output from the respective sensors. In particular, if ejection characteristics (ejection amount or ejection speed) of the liquid ejected from the liquid ejection head 2 are externally affected, in accordance with temperature of the liquid ejection head 2, temperature of the liquid inside the liquid tank, or pressure applied to the liquid ejection head 2 by the liquid of the liquid tank, a drive signal for causing the liquid ejection head 2 to eject the liquid may be changed.

(Overall Configuration of Liquid Ejection Head)

Figure 5A:
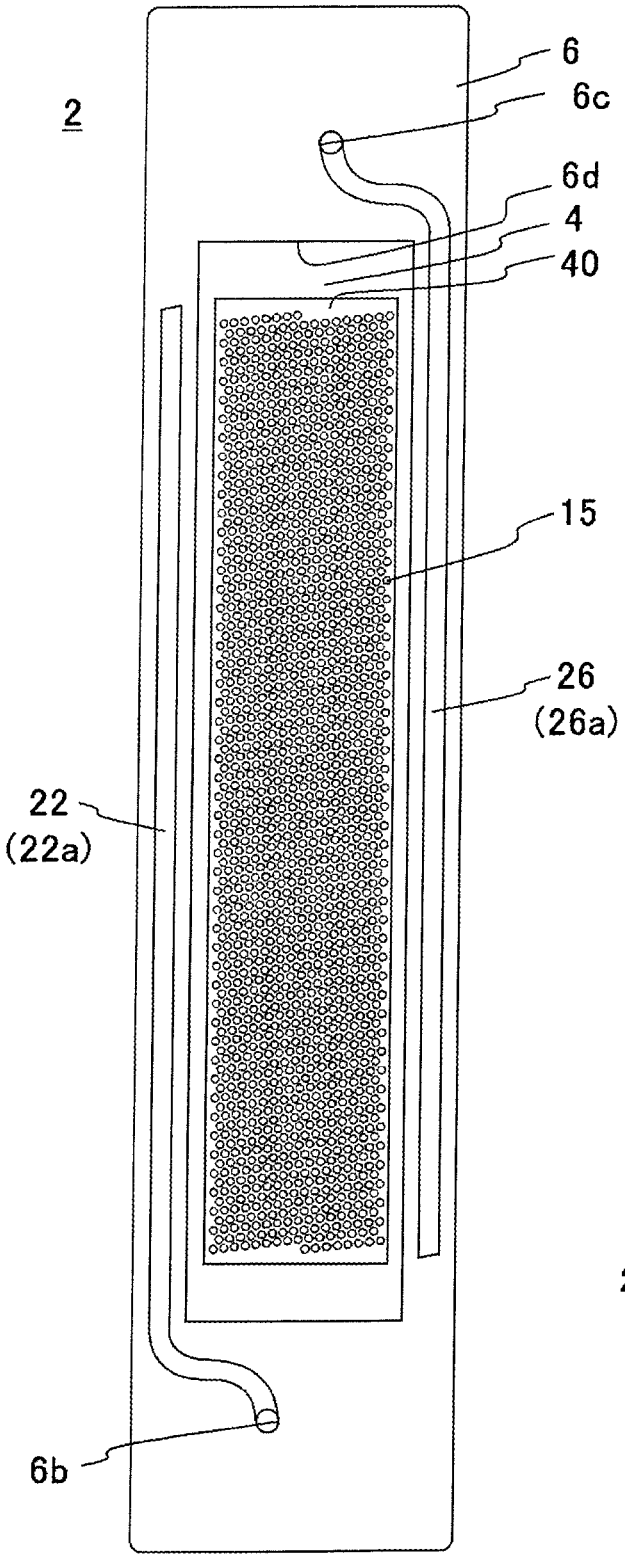
FIG. 5A is a plan view of the head body when a portion of the second flow path member is transparently viewed.
Figure 5B:
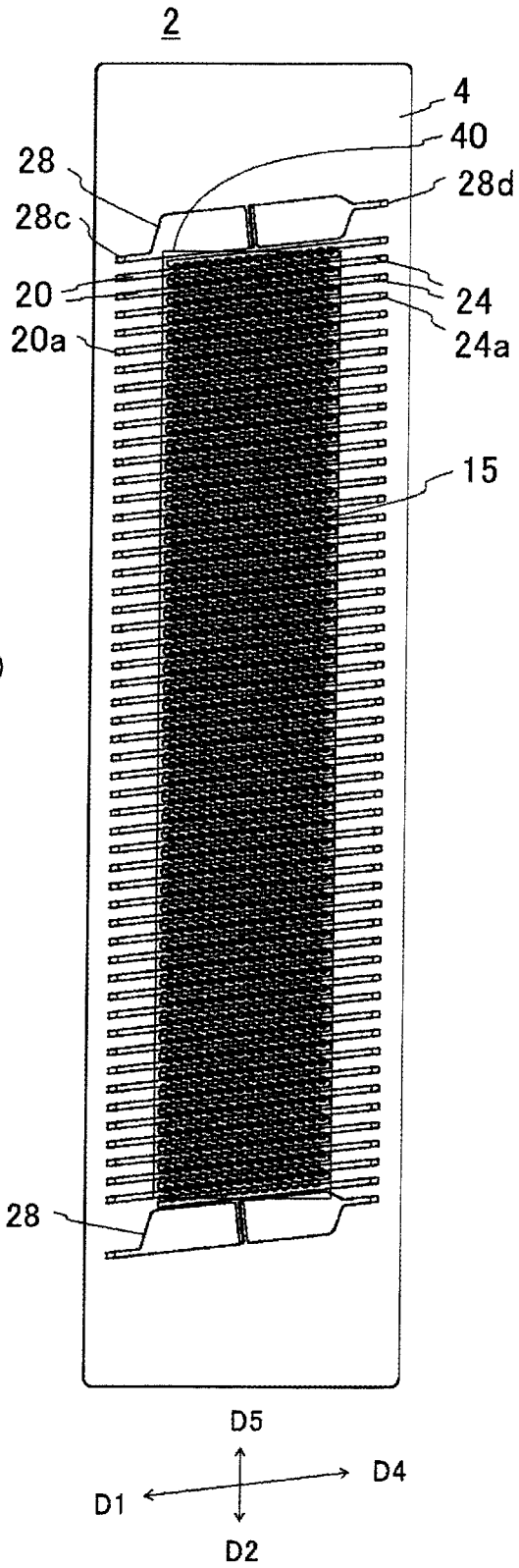
FIG. 5B is a plan view of the head body when the second flow path member is transparently viewed.
Figure 6:
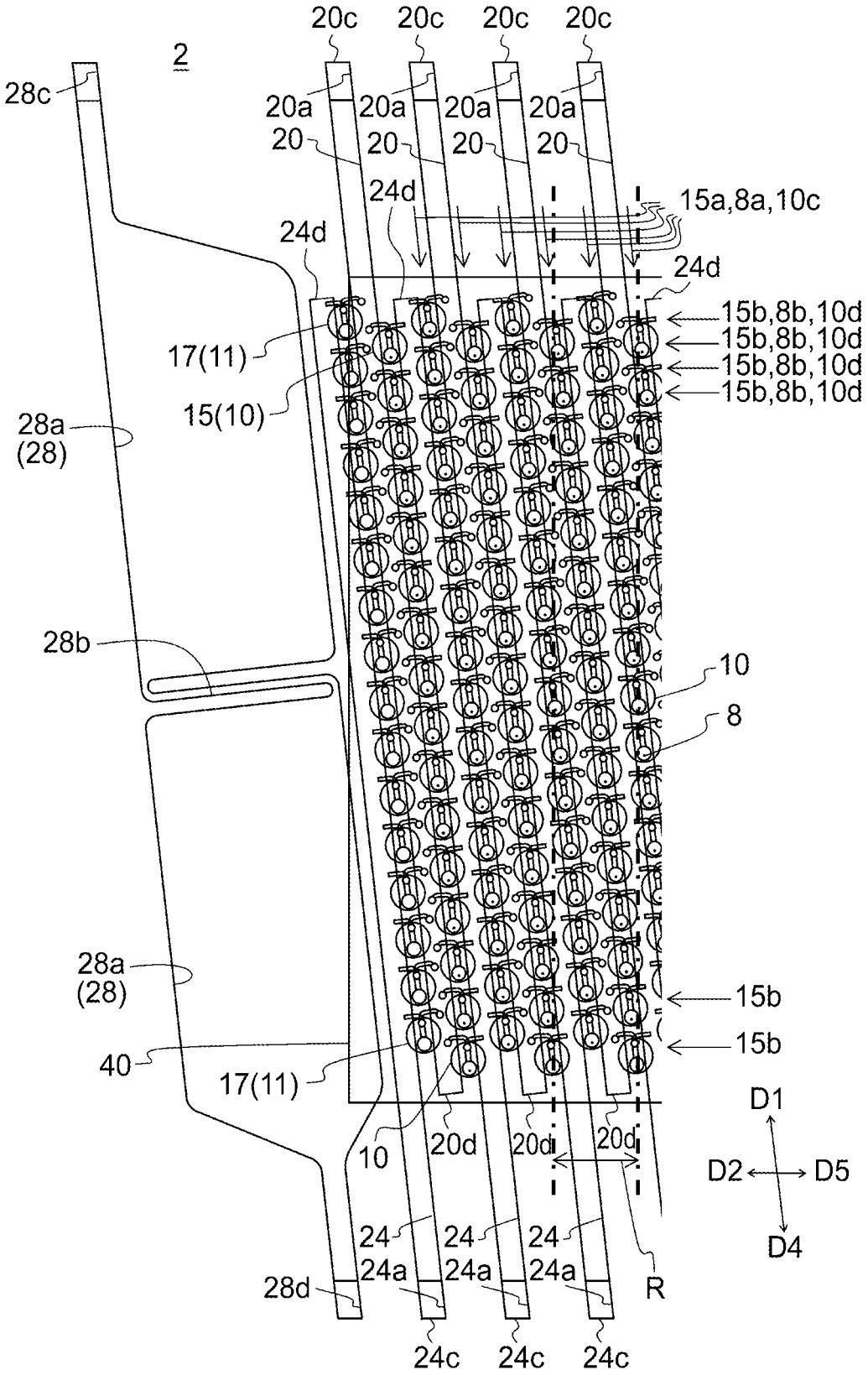
FIG. 6 is an enlarged plan view illustrating a portion in FIG. 5.

Next, the liquid ejection head 2 according to the first embodiment will be described with reference to FIGS. 2 to 9. In FIGS. 5 and 6, in order to facilitate understanding of the drawings, a flow path which is located below other members and needs to be illustrated using a broken line is illustrated using a solid line. FIG. 5A transparently illustrates a portion of a second flow path member 6, and FIG. 5B transparently illustrates the whole second flow path member 6. In FIG. 9, a flow of the liquid in the related art is illustrated using the broken line, a flow of the liquid in the ejection unit 15 is illustrated using the solid line, and a flow of the liquid supplied from a second individual flow path 14 is illustrated using a long broken line.

The drawings illustrate a first direction D1, a second direction D2, a third direction D3, a fourth direction D4, a fifth direction D5, and a sixth direction D6. The first direction D1 is oriented to one side in an extending direction of a first common flow path 20 and a second common flow path 24. The fourth direction D4 is oriented to the other side of the extending direction of the first common flow path 20 and the second common flow path 24. The second direction D2 is oriented to one side in an extending direction of a first integrated flow path 22 and a second integrated flow path 26. The fifth direction D5 is oriented to the other side in the extending direction of the first integrated flow path 22 and the second integrated flow path 26. The third direction D3 is oriented to one side in a direction perpendicular to the extending direction of the first integrated flow path 22 and the second integrated flow path 26. The sixth direction D6 is oriented to the other side in the direction perpendicular to the extending direction of the first integrated flow path 22 and the second integrated flow path 26.

The liquid ejection head 2 will be described with reference to a first individual flow path 12 as a first flow path, a second individual flow path 14 as a second flow path, a third individual flow path 16 as a fourth flow path, a first common flow path 20 as a third flow path, and a second common flow path 24 as a fifth flow path.

Figure 2:
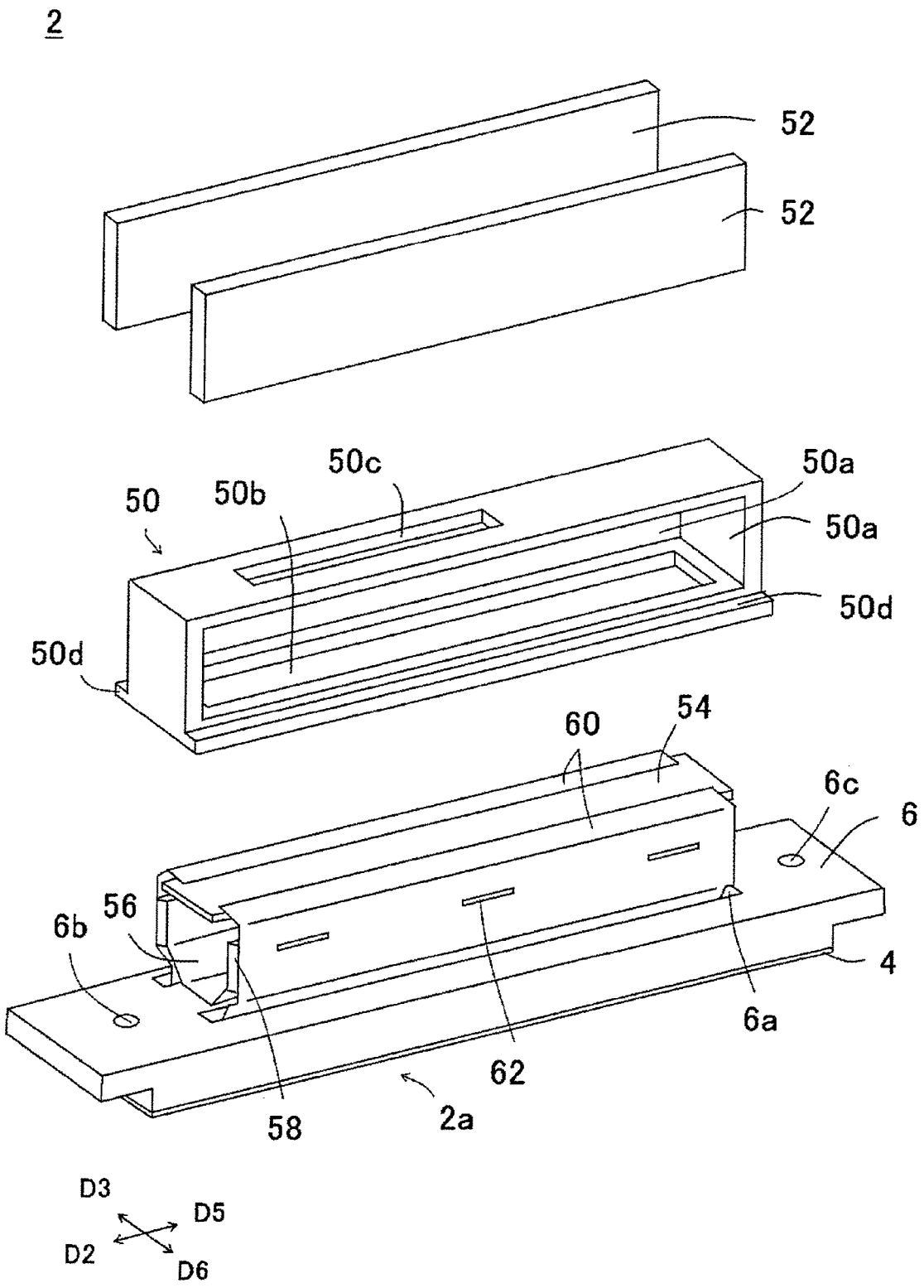
FIG. 2 is an exploded perspective view of the liquid ejection head according to the first embodiment.
Figure 3A:
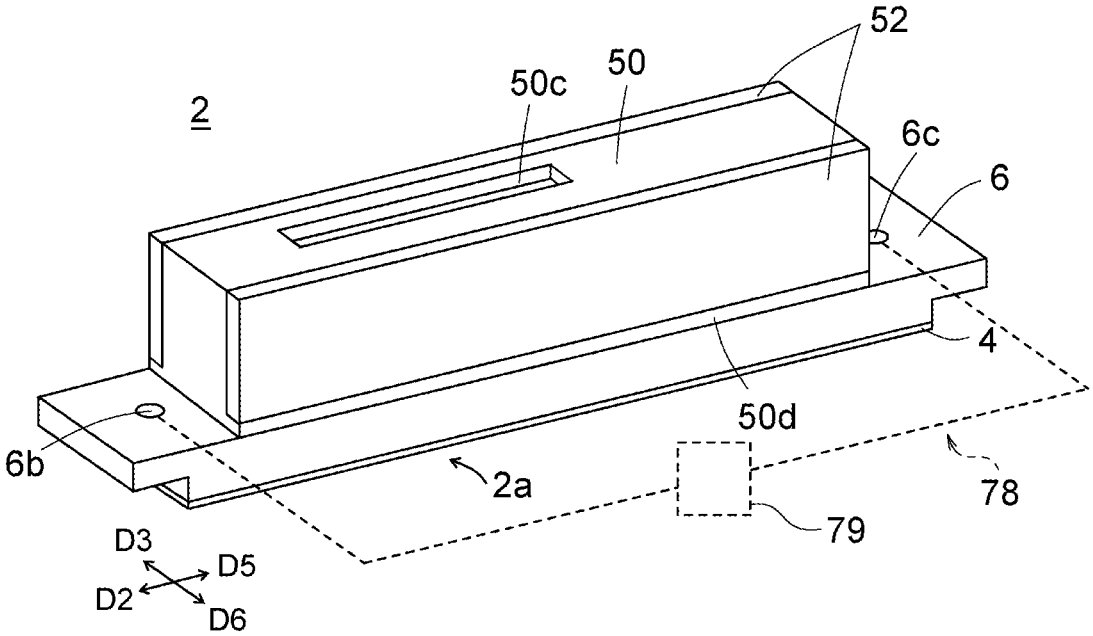
FIG. 3A is a perspective view of the liquid ejection head in FIG. 2.
Figure 3B:
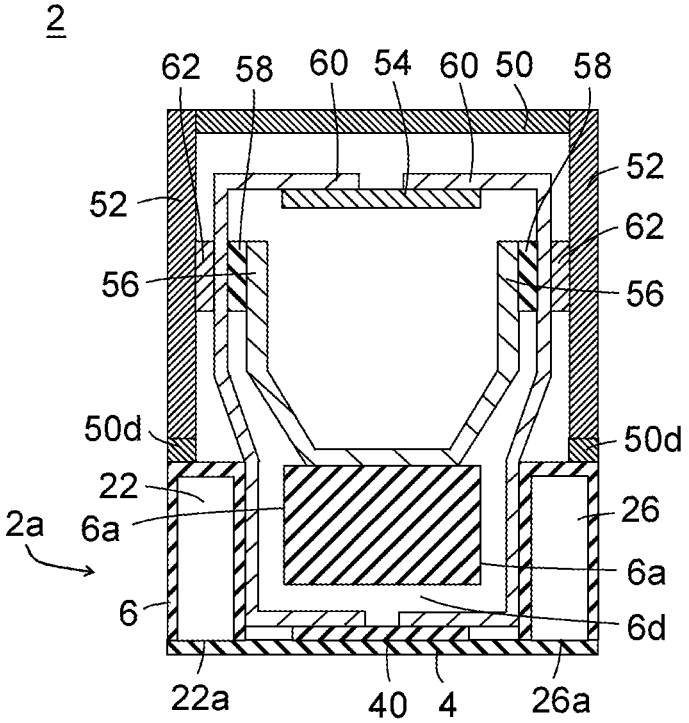
FIG. 3B is a sectional view of the liquid ejection head in FIG. 2.

As illustrated in FIGS. 2 and 3, the liquid ejection head 2 includes a head body 2*a*, a housing 50, a heat sink 52, a wiring board 54, a pressing member 56, an elastic member 58, a signal transmission unit 60, and a driver IC 62. The liquid ejection head 2 may include the head body 2*a*, and may not necessarily include the housing 50, the heat sink 52, the wiring board 54, the pressing member 56, the elastic member 58, the signal transmission unit 60, and the driver IC 62.

In the liquid ejection head 2, the signal transmission unit 60 is pulled out from the head body 2*a*, and the signal transmission unit 60 is electrically connected to the wiring board 54. The signal transmission unit 60 has the driver IC 62 for controlling the driving of the liquid ejection head 2. The driver IC 62 is pressed against the heat sink 52 by the pressing member 56 via the elastic member 58. A support member for supporting the wiring board 54 is omitted in the illustration.

The heat sink 52 can be formed of metal or an alloy, and is disposed in order to externally dissipate heat of the driver IC 62. The heat sink 52 is joined to the housing 50 by using a screw or an adhesive.

The housing 50 is placed on an upper surface of the head body 2*a*, and covers each member configuring the liquid ejection head 2 by using the housing 50 and the heat sink 52. The housing 50 includes a first opening 50*a*, a second opening 50*b*, a third opening 50*c*, and a heat insulator 50*d*. The first openings 50*a* are respectively disposed so as to face the third direction D3 and the sixth direction D6. Since the heat sink 52 is located in the first opening 50*a*, the first opening 50*a* is sealed. The second opening 50*b* is open downward, and the wiring board 54 and the pressing member 56 are located inside the housing 50 via the second opening 50*b*. The third opening 50*c* is open upward, and accommodates a connector (not illustrated) disposed in the wiring board 54.

The heat insulator 50*d* is disposed so as to extend in the fifth direction D5 from the second direction D2, and is located between the heat sink 52 and the head body 2*a*. In this manner, it is possible to reduce a possibility that the heat dissipated to the heat sink 52 may be transferred to the head body 2*a*. The housing 50 can be formed of metal, an alloy, or a resin.

Figure 4A:
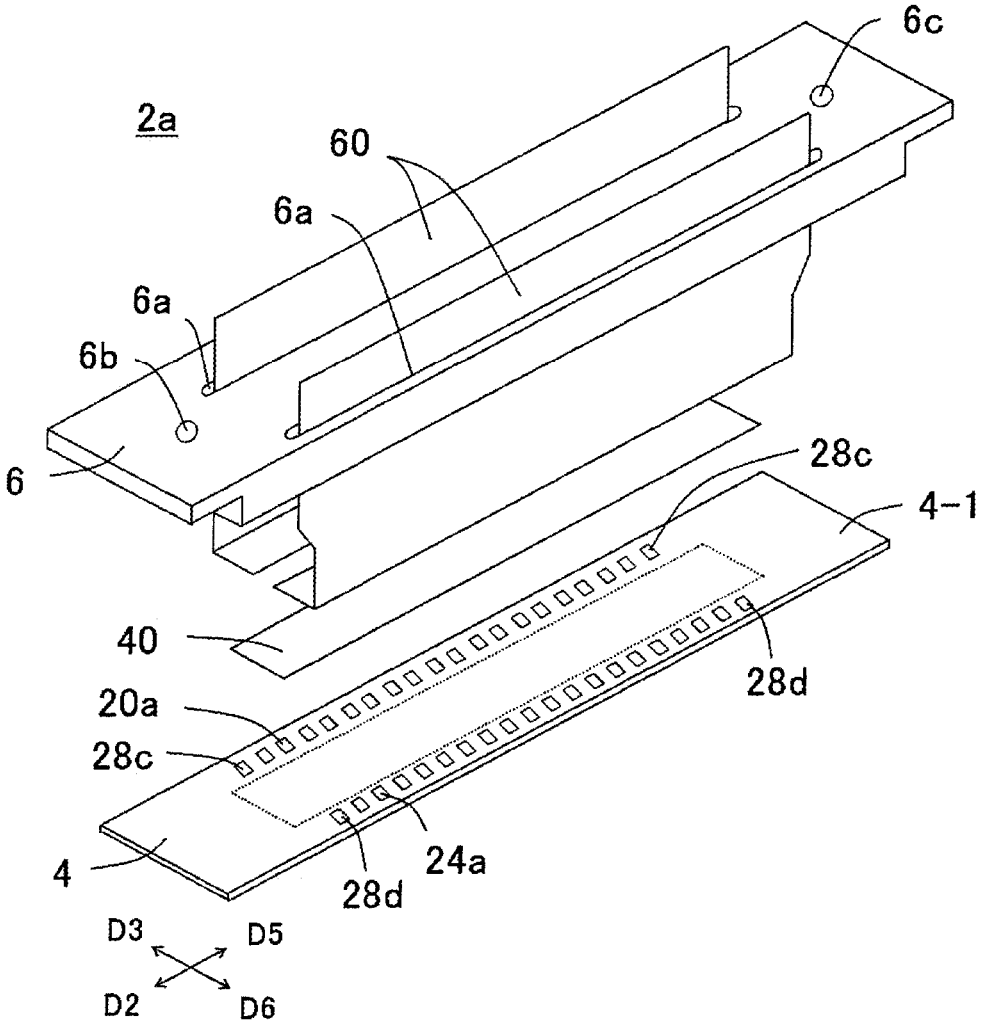
FIG. 4A is an exploded perspective view of a head body.

As illustrated in FIG. 4A, the head body 2*a* has a planar shape which is long from the second direction D2 toward the fifth direction D5, and has a first flow path member 4, a second flow path member 6, and a piezoelectric actuator board 40. In the head body 2*a*, the piezoelectric actuator board 40 and the second flow path member 6 are disposed on an upper surface of the first flow path member 4. The piezoelectric actuator board 40 is placed in a region illustrated using a broken line in FIG. 4A. The piezoelectric actuator board 40 is disposed in order to pressurize the plurality of pressurizing chambers 10 (refer to FIG. 8) disposed in the first flow path member 4, and has a plurality of displacement elements 48 (refer to FIG. 8).

(Overall Configuration of Flow Path Member)

The first flow path member 4 internally has a plurality of flow paths, and guides the liquid supplied from the second flow path member 6 to the ejection hole 8 (refer to FIG. 8) disposed on a lower surface. An upper surface of the first flow path member 4 serves as a pressurizing chamber surface 4-1, and openings 20*a*, 24*a*, 28*c*, and 28*d* are formed in the pressurizing chamber surface 4-1. The plurality of openings 20*a* is disposed, and is arrayed along the fifth direction D5 from the second direction D2. The opening 20*a* is located in an end portion in the third direction D3 of the pressurizing chamber surface 4-1. The plurality of openings 24*a* is disposed, and is arrayed along the fifth direction D5 from the second direction D2. The opening 24*a* is located in an end portion in the sixth direction D6 of the pressurizing chamber surface 4-1. The opening 28*c* is disposed outside the opening 20*a* in the second direction D2 and outside the opening 20*a* in the fifth direction D5. The opening 28*d* is disposed outside the opening 24*a* in the second direction D2 and outside the opening 24*a* in the fifth direction D5.

The second flow path member 6 internally has a plurality of flow paths, and guides the liquid supplied from the liquid tank to the first flow path member 4. The second flow path member 6 is disposed on an outer peripheral portion of the pressurizing chamber surface 4-1 of the first flow path member 4, and is joined to the first flow path member 4 via an adhesive (not illustrated) outside a placement region of the piezoelectric actuator board 40.

(Second Flow Path Member (Integrated Flow Path))

Figure 4B:
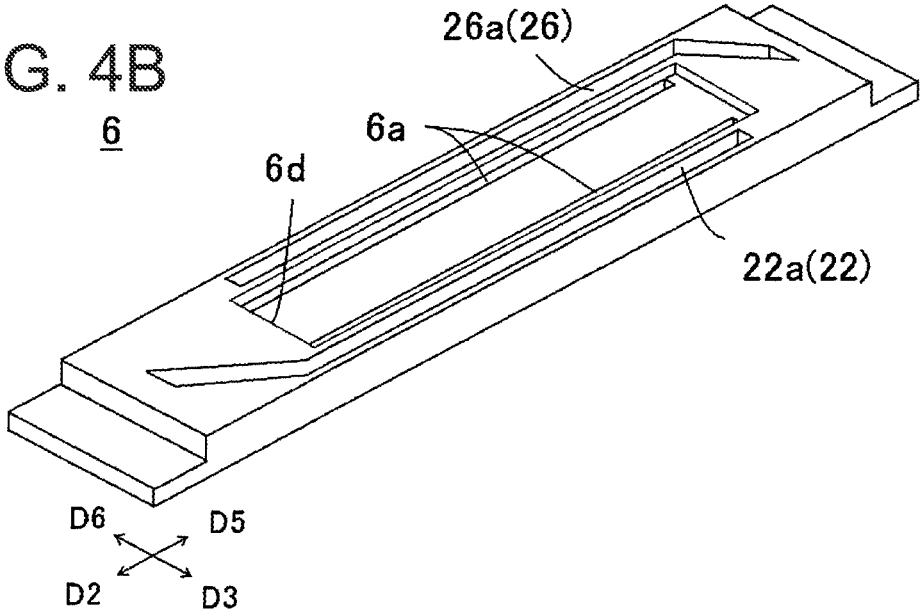
FIG. 4B is a perspective view when viewed from a lower surface of a second flow path member.

As illustrated in FIGS. 4 and 5, the second flow path member 6 has a through-hole 6*a* and openings 6*b*, 6*c*, 6*d*, 22*a*, and 26*a*. The through-hole 6*a* is formed so as to extend in the fifth direction D5 from the second direction D2, and is located outside the placement region of the piezoelectric actuator board 40. The signal transmission unit 60 is inserted into the through-hole 6*a*.

The opening 6*b* is disposed on the upper surface of the second flow path member 6, and is located in an end portion of the second flow path member in the second direction D2. The opening 6*b* supplies the liquid from the liquid tank to the second flow path member 6. The opening 6*c* is disposed on the upper surface of the second flow path member 6, and is located in an end portion of the second flow path member in the fifth direction D5. The opening 6*c* collects the liquid from the second flow path member 6 to the liquid tank. The opening 6*d* is disposed on the lower surface of the second flow path member 6, and the piezoelectric actuator board 40 is located in a space formed by the opening 6*d*.

The opening 22*a* is disposed on the lower surface of the second flow path member 6, and is disposed so as to extend in the fifth direction D5 from the second direction D2. The opening 22*a* is formed in an end portion of the second flow path member 6 in the third direction D3, and is disposed in the third direction D3 from the through-hole 6*a*.

The opening 22*a* communicates with the opening 6*b*. The opening 22*a* is sealed by the first flow path member 4, thereby forming the first integrated flow path 22. The first integrated flow path 22 is formed so as to extend in the fifth direction D5 from the second direction D2, and supplies the liquid to the opening 20*a* and the opening 28*c* of the first flow path member 4.

The opening 26*a* is disposed on the lower surface of the second flow path member 6, and is disposed so as to extend in the fifth direction D5 from the second direction D2. The opening 26*a* is formed in an end portion of the second flow path member 6 in the sixth direction D6, and is disposed in the sixth direction D6 from the through-hole 6*a*.

The opening 26*a* communicates with the opening 6*c*. The opening 26*a* is sealed by the first flow path member 4, thereby forming the second integrated flow path 26. The second integrated flow path 26 is formed so as to extend in the fifth direction D5 from the second direction D2, and collects the liquid from the opening 24*a* and the opening 28*d* of the first flow path member 4.

According to the above-described configuration, the liquid supplied from the liquid tank to the opening 6*b* is supplied to the first integrated flow path 22, and flows into the first common flow path 20 via the opening 22*a*. The liquid is supplied to the first flow path member 4. Then, the liquid collected by the second common flow path 24 flows into the second integrated flow path 26 via the opening 26*a*. The liquid is collected outward via the opening 6*c*. The second flow path member 6 may not necessarily be disposed therein.

The liquid may be supplied and collected using any suitable means. For example, as illustrated using a dotted line in FIG. 3A, the printer 1 may have a circulation flow path 78 including the first integrated flow path 22, a flow path of the first flow path member 4, and the second integrated flow path 26, and a flow forming unit 79 forming a flow from the first integrated flow path 22 to the second integrated flow path 26 by way of a flow path of the first flow path member 4.

A configuration of the flow forming unit 79 may be appropriately adopted. For example, the flow forming unit 79 includes a pump, and suctions the liquid from the opening 6*c* and/or ejects the liquid to the opening 6*b*. For example, the flow forming unit 79 may have a collection space for storing the liquid collected from the opening 6*c*, a supply space for storing the liquid to be supplied to the opening 6*b*, and a pump for supplying the liquid to the supply space from the collection space. A liquid level of the supply space may be raised to be higher than a liquid level of the collection space. In this manner, a pressure difference may be generated between the first integrated flow path 22 and the second integrated flow path 26.

A portion located outside the first flow path member 4 and the second flow path member 6 in the circulation flow path 78 and the flow forming unit 79 may be a portion of the liquid ejection head 2, and may be disposed outside the liquid ejection head 2.

(First Flow Path Member (Common Flow Path and Ejection Unit))

As illustrated in FIGS. 5 to 8, the first flow path member 4 is formed by stacking a plurality of plates 4*a* to 4*m* one on another, and has a pressurizing chamber surface 4-1 disposed on the upper side and an ejection hole surface 4-2 disposed on the lower side when a cross section is viewed in a stacking direction. The piezoelectric actuator board 40 is placed on the pressurizing chamber surface 4-1, and the liquid is ejected from the ejection hole 8 which is open on the ejection hole surface 4-2. The plurality of the plates 4*a* to 4*m* can be formed of metal, an alloy, or a resin. The first flow path member 4 may be integrally formed of the resin without stacking the plurality of the plates 4*a* to 4*m* one on another.

The first flow path member 4 has the plurality of first common flow paths 20, the plurality of second common flow paths 24, a plurality of end portion flow paths 28, a plurality of ejection units 15, and a plurality of dummy ejection units 17.

The first common flow path 20 is disposed so as to extend in the fourth direction D4 from the first direction D1, and is formed so as to communicate with the opening 20*a*. The first common flow path 20 is a dead end flow path. That is, the first common flow path 20 extends from an open end portion 20*c* (having an opening 20*a* in another viewpoint) to a closed end portion 20*d*. The plurality of first common flow paths 20 is arrayed from the second direction D2 to the fifth direction D5. A fact that the end portion 20*d* is closed indicates that an opening area of the end portion 20*d* is zero. Accordingly, the end portion 20*d* may be regarded to have the opening area which is smaller than that of the end portion 20*c*.

The second common flow path 24 is disposed so as to extend in the first direction D1 from the fourth direction D4, and is formed so as to communicate with the opening 24*a*. The second common flow path 24 is a dead end flow path. That is, the second common flow path 24 extends from an open end portion 24*c* (having an opening 24*a* in another viewpoint) to a closed end portion 24*d*. The plurality of second common flow paths 24 is arrayed from the second direction D2 to the fifth direction D5, and is located between the first common flow paths 20 adjacent to each other. Therefore, the first common flow path 20 and the second common flow path 24 are alternately arranged from the second direction D2 toward the fifth direction D5. Similarly to the end portion 20*d*, the end portion 24*d* may be regarded to have an opening area which is smaller than that of the end portion 24*c*.

For example, the first common flow path 20 and/or the second common flow path 24 linearly extend. The width of the first common flow path 20 and/or the second common flow path 24 (length in the direction perpendicular to the direction D1) may be constant without depending on the position in the flow path direction (direction D1), or may vary depending on the position in the flow path direction. In the latter case, for example, the width of the first common flow path 20 and/or the second common flow path 24 may be periodically narrowed at a position of the partial flow path 10*b* (to be described later) of the ejection unit 15. The width of the first common flow path 20 and/or the second common flow path 24 may vary on the downstream side and the upstream side. The thickness (paper penetrating direction in FIG. 6) of the first common flow path 20 and/or the second common flow path 24 may be constant without depending on the position in the flow path direction, or may vary depending on the position in the flow path direction.

A damper 30 is formed in the second common flow path 24 of the first flow path member 4, and a space 32 facing the second common flow path 24 is located via the damper 30. The damper 30 has a first damper 30*a* and a second damper 30*b*. The space 32 has a first space 32*a* and a second space 32*b*. The first space 32*a* is disposed above the second common flow path 24 through which the liquid flows via the first damper 30*a*. The second space 32*b* is disposed below the second common flow path 24 through which the liquid flows via the second damper 30*b*.

The first damper 30*a* is formed in substantially the whole region above the second common flow path 24. Therefore, in a plan view, the first damper 30*a* has a shape which is the same as that of the second common flow path 24. The first space 32*a* is formed in substantially the whole region above the first damper 30*a*. Therefore, in a plan view, the first space 32*a* has a shape which is the same as that of the second common flow path 24.

The second damper 30*b* is formed in substantially the whole region below the second common flow path 24. Therefore, in a plan view, the second damper 30*b* has a shape which is the same as that of the second common flow path 24. The second space 32*b* is formed in substantially the whole region below the second damper 30*b*. Therefore, in a plan view, the second space 32*b* has a shape which is the same as that of the second common flow path 24. The first flow path member 4 can mitigate pressure fluctuations of the second common flow path 24 by disposing the damper 30 in the second common flow path 24, and thus, fluid crosstalk is less likely to occur.

The first damper 30*a* and the first space 32*a* can be formed in such a way that grooves are formed in the plates 4*d* and 4*e* by means of half etching and the grooves are joined to face each other. In this case, a portion left by means of the half etching of the plate 4*e* serves as the first damper 30*a*. Similarly, the second damper 30*b* and the second space 32*b* can be manufactured in such a way that the grooves are formed in the plates 4*k* and 4*l* by means of the half etching.

The end portion flow path 28 is formed in an end portion in the second direction D2 of the first flow path member 4 and an end portion in the fifth direction D5. The end portion flow path 28 has a wide portion 28*a*, a narrow portion 28*b*, and openings 28*c* and 28*d*. The liquid supplied from the opening 28*c* flows into the end portion flow path 28 by flowing through the wide portion 28*a*, the narrow portion 28*b*, the wide portion 28*a*, and the opening 28*d* in this order. In this manner, the liquid is present in the end portion flow path 28, and the liquid flows into the end portion flow path 28. Accordingly, the temperature of the first flow path member 4 located around the end portion flow path 28 is allowed to be uniform by the liquid. Therefore, it is possible to reduce a possibility that the first flow path member 4 may be dissipated from the end portion in the second direction D2 and the end portion in the fifth direction D5.

(Ejection Unit)

Figure 7A:
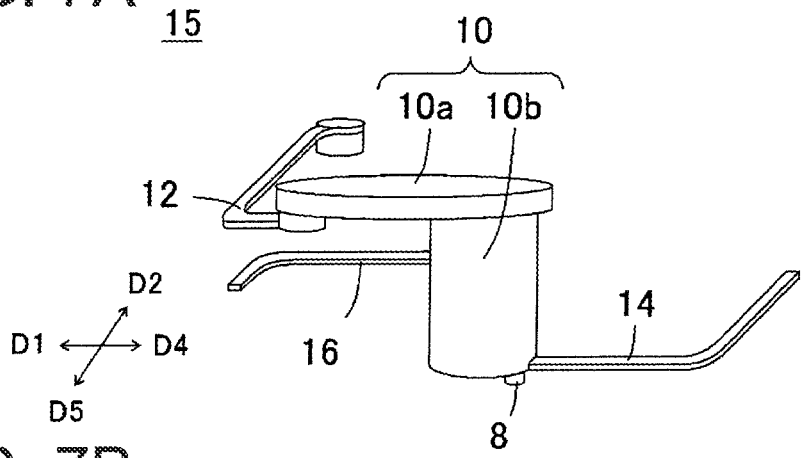
FIG. 7A is a perspective view of an ejection unit.

Referring to FIGS. 6 and 7, the ejection unit 15 will be described. The ejection unit 15 has the ejection hole 8, the pressurizing chamber 10, the first individual flow path (first flow path) 12, the second individual flow path (second flow path) 14, and the third individual flow path (third flow path) 16. In FIG. 6, the second individual flow path 14 is omitted in the illustration. In the liquid ejection head 2, the liquid is supplied from the first individual flow path 12 and the second individual flow path 14 to the pressurizing chamber 10, and the third individual flow path 16 collects the liquid from the pressurizing chamber 10. As will be described in detail later, flow path resistance of the second individual flow path 14 is lower than flow path resistance of the first individual flow path 12.

The ejection unit 15 is disposed between the first common flow path 20 and the second common flow path 24 which are adjacent to each other, and is formed in a matrix form in a plane direction of the first flow path member 4. The ejection unit 15 has an ejection unit column 15*a* and an ejection unit row 15*b*. In the ejection unit column 15*a*, the ejection units 15 are arrayed from the first direction D1 toward the fourth direction D4. In the ejection unit row 15*b*, the ejection units 15 are arrayed from the second direction D2 toward the fifth direction D5.

In the respective ejection unit columns 15*a*, for example, orientations of the ejection units 15 are the same as each other in the plurality of ejection units 15. For example, in the respective ejection unit columns 15*a*, the directions in which the first individual flow path 12, the second individual flow path 14, and the third individual flow path 16 extend from the pressurizing chamber 10 are the same as each other in the plurality of ejection units 15. Further, between the ejection unit column 15*a* (between all of the ejection unit columns 15*a* in another viewpoint) adjacent to each other, the directions with regard to the first direction D1 (flow path direction of the common flow path) of the ejection unit 15 are the same as each other, for example. For example, in any one of the ejection unit columns 15*a*, the first individual flow path 12 and the third individual flow path 16 are located in the first direction D1 with respect to the pressurizing chamber 10, and the second individual flow path 14 is located in the fourth direction D4 with respect to the pressurizing chamber 10. Between the ejection unit columns 15*a* adjacent to each other, the directions with regard to the direction (width direction of the common flow path) perpendicular to the first direction D1 of the ejection unit 15 are opposite to each other, for example.

The pressurizing chamber 10 has a pressurizing chamber column 10*c* and a pressurizing chamber row 10*d*. The ejection hole 8 has an ejection hole column 8*a* and an ejection hole row 8*b*. Similarly, the ejection hole column 8*a* and the pressurizing chamber column 10*c* are arrayed from the first direction D1 toward the fourth direction D4. Similarly, the ejection hole row 8*b* and the pressurizing chamber row 10*d* are arrayed from the second direction D2 toward the fifth direction D5.

An angle formed between the first direction D1 and the fourth direction D4 and an angle formed between the second direction D2 and the fifth direction D5 are shifted from a right angle. Therefore, the ejection holes 8 belonging to the ejection hole column 8*a* arrayed along the first direction D1 are arranged so as to be shifted from each other in the second direction D2 as much as the shifted amount from the right angle. The ejection hole column 8*a* is located parallel to the second direction D2. Accordingly, the ejection holes 8 belonging to the different ejection hole column 8*a* are arranged so as to be shifted from each other in the second direction D2 as much as the shifted amount. In combination thereof, the ejection holes 8 of the first flow path member 4 are arranged at a regular interval in the second direction D2. In this manner, the printing can be performed so as to fill a predetermined range with pixels formed by the ejected liquid.

In FIG. 6, if the ejection hole 8 is projected in the third direction D3 and the sixth direction D6, thirty-two ejection holes 8 are projected in a range of a virtual straight line R, and the respective ejection holes 8 are arrayed at an interval of 360 dpi inside the virtual straight line R. In this manner, if the recording medium P is transported and printed in a direction perpendicular to the virtual straight line R, the printing can be performed using a resolution of 360 dpi.

The dummy ejection unit 17 is disposed between the first common flow path 20 located closest in the second direction D2 and the second common flow path 24 located closest in the second direction D2. The dummy ejection unit 17 is also disposed between the first common flow path 20 located closest in the fifth direction D5 and the second common flow path 24 located closest in the fifth direction D5. The dummy ejection unit 17 is disposed in order to stabilize the ejection of the ejection unit column 15*a* located closest in the second direction D2 or the fifth direction D5.

Figure 7B:
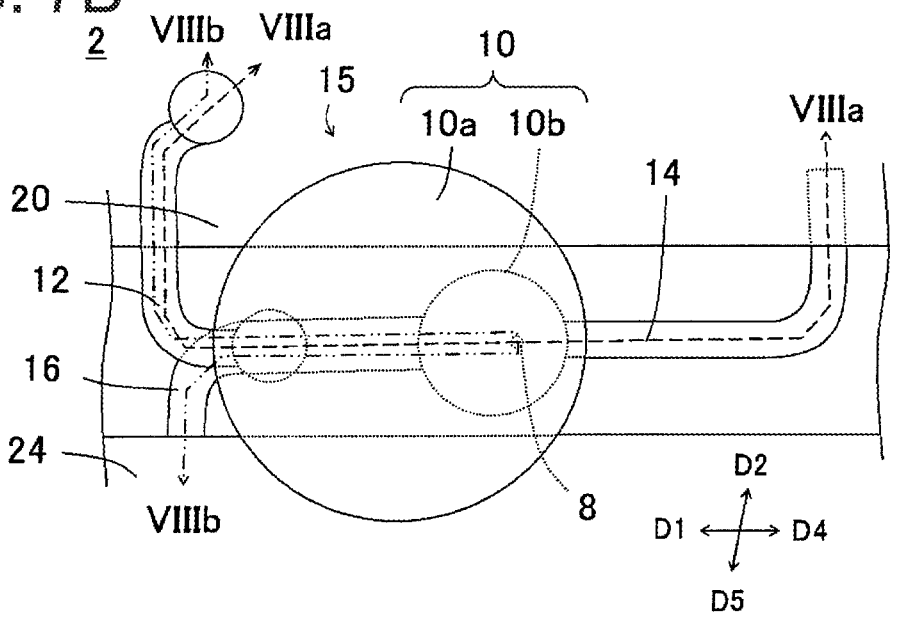
FIG. 7B is a plan view of the ejection unit.
Figure 7C:
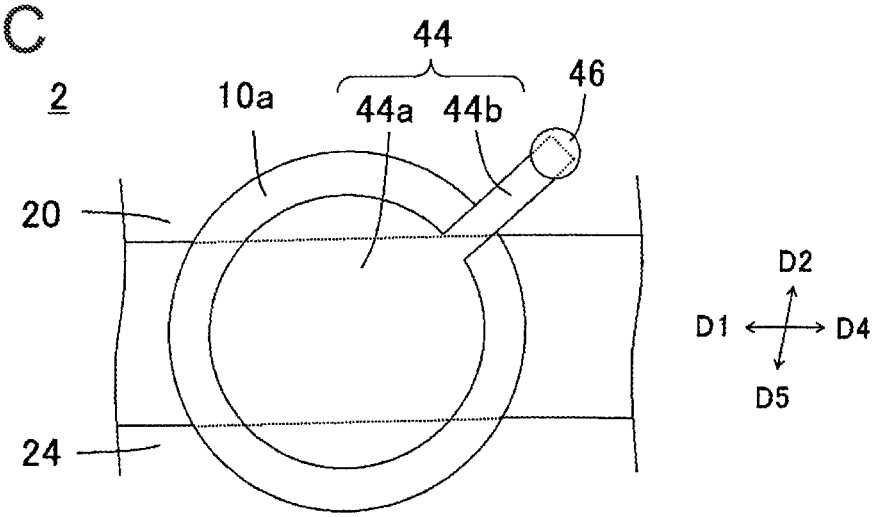
FIG. 7C is a plan view illustrating an electrode on the ejection unit.
Figure 8A:
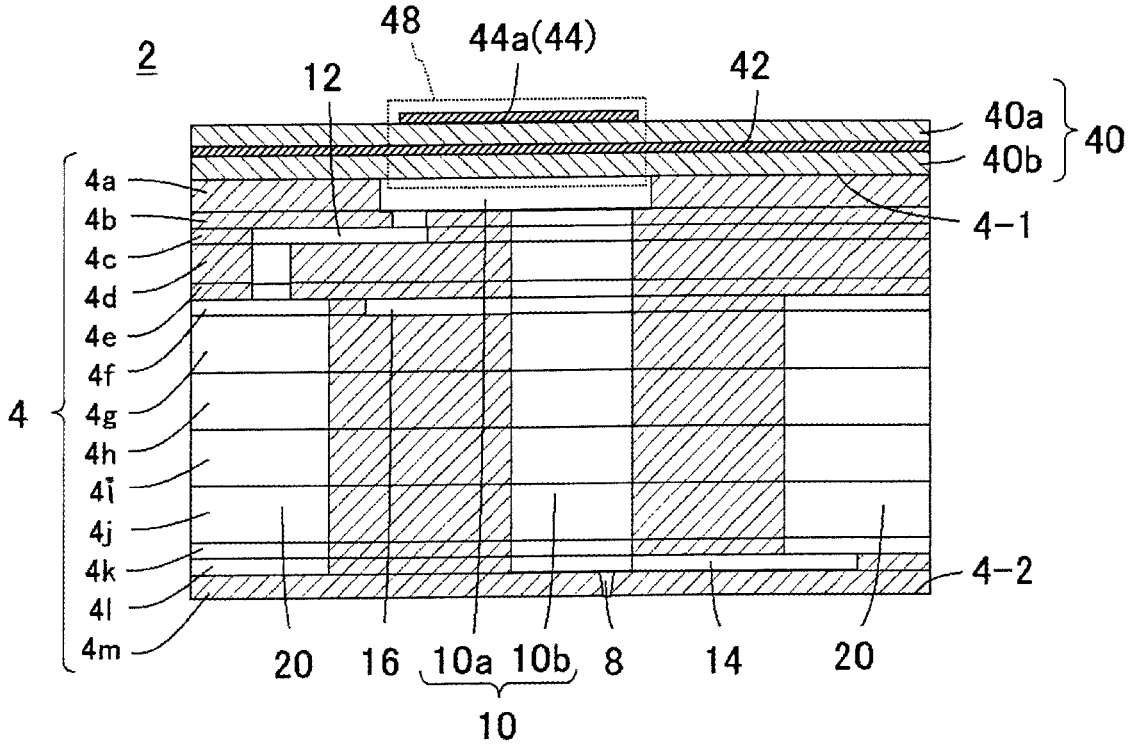
FIG. 8A is a sectional view taken along line Villa-Villa in FIG. 7B.
Figure 8B:
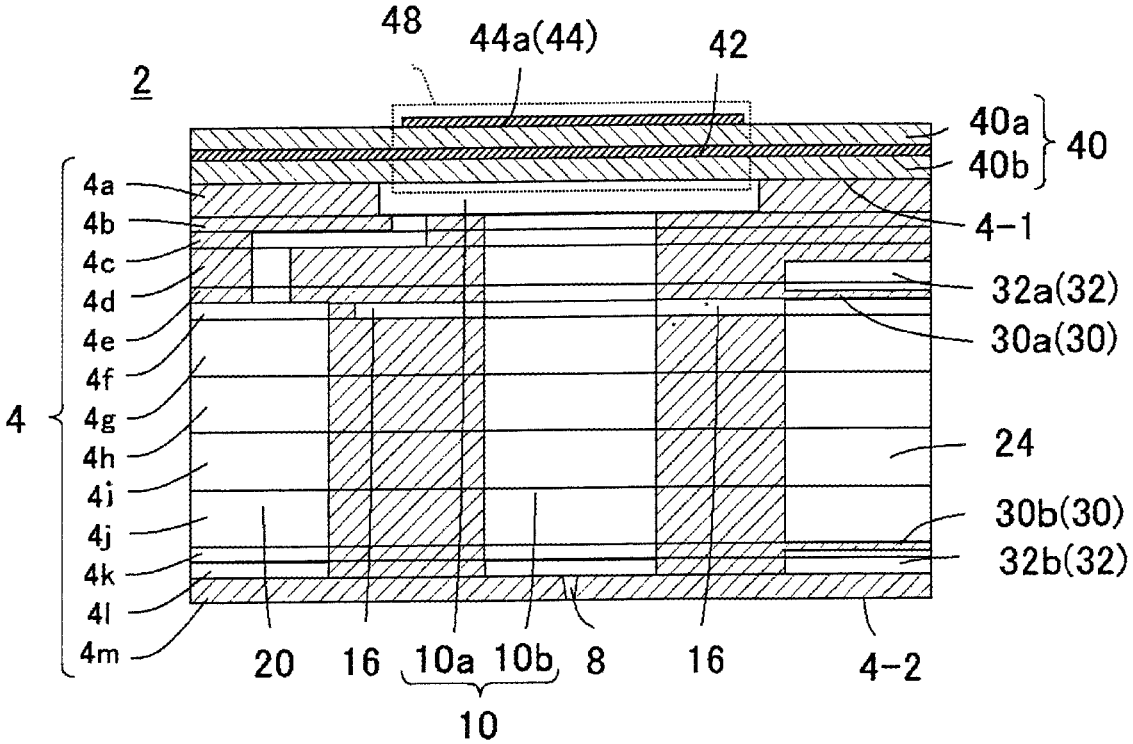
FIG. 8B is a sectional view taken along line VIIIb-VIIIb in FIG. 7B.
Figure 9:
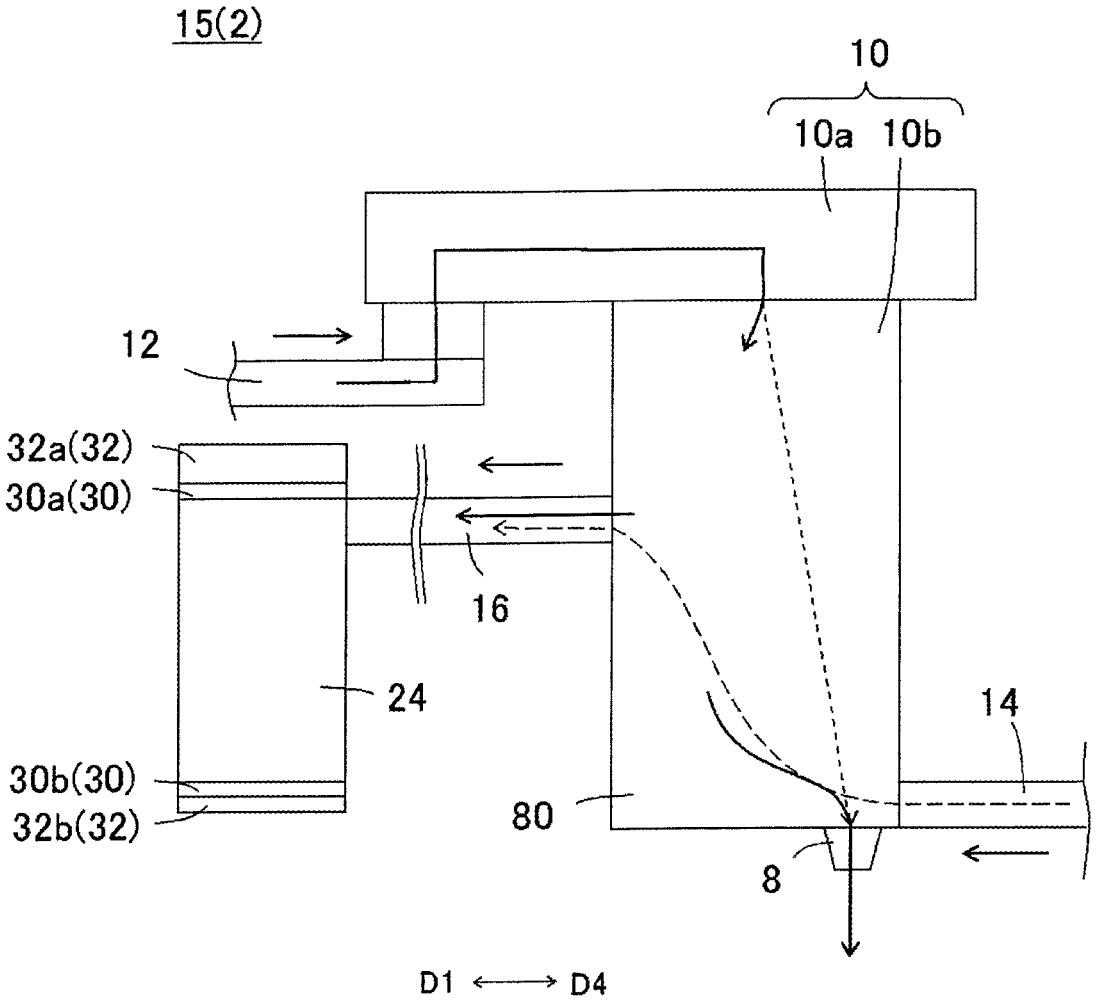
FIG. 9 is a conceptual diagram illustrating a flow of a fluid inside a liquid ejection unit.

As illustrated in FIGS. 7 and 8, the pressurizing chamber 10 has a pressurizing chamber body 10*a* and a partial flow path 10*b*. The pressurizing chamber body 10*a* has a circular shape in a plan view, and the partial flow path 10*b* extends downward from the pressurizing chamber body 10*a*. The pressurizing chamber body 10*a* pressurizes the liquid inside the partial flow path 10*b* by receiving pressure from the displacement element 48 disposed on the pressurizing chamber body 10*a*.

The pressurizing chamber body 10*a* has a substantially disc shape, and a planar shape thereof is circular. Since the planar shape is circular, it is possible to increase a volume change of the pressurizing chamber 10 which is caused by a displacement amount and displacement. The partial flow path 10*b* has a substantially cylindrical shape having a diameter which is smaller than that of the pressurizing chamber body 10*a*, and the planar shape is circular. The partial flow path 10*b* is accommodated inside the pressurizing chamber body 10*a* when viewed from the pressurizing chamber surface 4-1.

The partial flow path 10*b* may have a conical shape or a truncated conical shape whose sectional area decreases toward the ejection hole 8. In this manner, it is possible to increase the width of the first common flow path 20 and the second common flow path 24, and it is possible to reduce a difference in the above-described pressure loss.

The pressurizing chambers 10 are arranged along both sides of the first common flow path 20, and configure every one column on one side and total two columns of the pressurizing chamber column 10*c*. The first common flow path 20 and the pressurizing chambers 10 arrayed on both sides thereof are connected via the first individual flow path 12 and the second individual flow path 14.

The pressurizing chambers 10 are arranged along both sides of the second common flow path 24, and configure every one column on one side and total two columns of the pressurizing chamber column 10*c*. The second common flow path 24 and the pressurizing chambers 10 arrayed on both sides thereof are connected via the third individual flow path 16.

Referring to FIG. 7, the first individual flow path 12, the second individual flow path 14, and the third individual flow path 16 will be described.

The first individual flow path 12 connects the first common flow path 20 and the pressurizing chamber body 10*a* to each other. The first individual flow path 12 is connected to the first common flow path 20 between the end portion 20*c* and the end portion 20*d*. The first individual flow path 12 extends upward from the upper surface of the first common flow path 20, and thereafter, extends toward the fifth direction D5. The first individual flow path 12 extends toward the fourth direction D4. Thereafter, the first individual flow path 12 extends upward again, and is connected to the lower surface of the pressurizing chamber body 10*a*.

The second individual flow path 14 connects the first common flow path 20 and the partial flow path 10*b* to each other. The second individual flow path 14 is connected to the first common flow path 20 between the end portion 20*c* and the end portion 20*d*. The second individual flow path 14 extends toward the fifth direction D5 from the lower surface of the first common flow path 20, and extends toward the first direction D1. Thereafter, the second individual flow path 14 is connected to the side surface of the partial flow path 10*b*.

The third individual flow path 16 connects the second common flow path 24 and the partial flow path 10*b* to each other. The third individual flow path 16 is connected to the second common flow path 24 between the end portion 24*c* and the end portion 24*d*. The third individual flow path 16 extends toward the second direction D2 from the side surface of the second common flow path 24, and extends toward the fourth direction D4. Thereafter, the third individual flow path 16 is connected to the side surface of the partial flow path 10*b*.

The flow path resistance of the second individual flow path 14 is lower than the flow path resistance of the first individual flow path 12. In order to cause the flow path resistance of the second individual flow path 14 to be lower than the flow path resistance of the first individual flow path 12, for example, the thickness of the plate 4*l* having the second individual flow path 14 may be thickened than the thickness of the plate 4*c* having the first individual flow path 12. In a plan view, the width of the second individual flow path 14 may be wider than the width of the first individual flow path 12. In a plan view, the length of the second individual flow path 14 may be shorter than the length of the first individual flow path 12.

According to the above-described configuration, in the first flow path member 4, the liquid supplied to the first common flow path 20 via the opening 20*a* flows into the pressurizing chamber 10 via the first individual flow path 12 and the second individual flow path 14, and the liquid is partially ejected from the ejection hole 8. The remaining liquid flows from the pressurizing chamber 10 into the second common flow path 24 via the third individual flow path 16, and is discharged via the opening 24*a* from the first flow path member 4 to the second flow path member 6.

(Piezoelectric Actuator)

The piezoelectric actuator board 40 will be described with reference to FIGS. 7C and 8. The piezoelectric actuator board 40 including the displacement elements 48 is joined to the upper surface of the first flow path member 4, and the respective displacement elements 48 are arranged to be located on the pressurizing chamber 10. The piezoelectric actuator board 40 occupies a region having a shape which is substantially the same as that of the pressurizing chamber group formed by the pressurizing chamber 10. The opening of the respective pressurizing chambers 10 is closed by joining the piezoelectric actuator board 40 to the pressurizing chamber surface 4-1 of the first flow path member 4.

The piezoelectric actuator board 40 has a stacked structure having two piezoelectric ceramic layers 40*a* and 40*b* serving as piezoelectric bodies. The piezoelectric ceramic layers 40*a* and 40*b* respectively have the thickness of approximately 20 μm. Both layers of the piezoelectric ceramic layers 40*a* and 40*b* extend across the plurality of pressurizing chambers 10.

The piezoelectric ceramic layers 40*a* and 40*b* are formed of a ferroelectric material, for example, a ceramic material such as a lead zirconate titanate (PZT) system, a $NaNbO_3$ system, a $BaTiO_3$ system, a $(BiNa)NbO_3$ system, and a $BiNaNb_5O_{15}$ system. The piezoelectric ceramic layer 40*b* serves as a diaphragm, and does not necessarily need to be a piezoelectric body. Alternatively, another ceramic layer, a metal plate, or a resin plate which is not the piezoelectric body may be used. The diaphragm may be configured to be shared as a member configuring a portion of the first flow path member 4. For example, unlike the illustrated example, the diaphragm may have the width throughout the pressurizing chamber surface 4-1, and may have an opening facing the openings 20*a*, 24*a*, 28*c*, and 28*d*.

A common electrode 42, an individual electrode 44, and a connection electrode 46 are formed in the piezoelectric actuator board 40. The common electrode 42 is formed over a substantially entire surface in a plane direction in a region between the piezoelectric ceramic layer 40*a* and the piezoelectric ceramic layer 40*b*. The individual electrode 44 is located at a position facing the pressurizing chamber 10 on the upper surface of the piezoelectric actuator board 40.

A portion interposed between the individual electrode 44 and the common electrode 42 of the piezoelectric ceramic layer 40*a* is polarized in the thickness direction, and serves as the displacement element 48 having a unimorph structure which is displaced if a voltage is applied to the individual electrode 44. Therefore, the piezoelectric actuator board 40 has the plurality of displacement elements 48.

The common electrode 42 can be formed of a metal material such as an Ag—Pd system, and the thickness of the common electrode 42 can be set to approximately 2 μm. The common electrode 42 is connected to a surface electrode (not illustrated) for the common electrode on the piezoelectric ceramic layer 40*a* through a via-hole formed by penetrating the piezoelectric ceramic layer 40*a*, and is grounded via the surface electrode for the common electrode. In this manner, the common electrode 42 is held at a ground potential.

The individual electrode 44 is formed of a metal material such as an Au system, and has an individual electrode body 44*a* and a lead electrode 44*b*. As illustrated in FIG. 7C, the individual electrode body 44*a* is formed in a substantially circular shape in a plan view, and is formed to be smaller than the pressurizing chamber body 10*a*. The lead electrode 44*b* is pulled out from the individual electrode body 44*a*, and the connection electrode 46 is formed on the lead electrode 44*b* which is pulled out.

For example, the connection electrode 46 is made of silver-palladium including glass frit, and is formed in a projection shape having the thickness of approximately 15 μm. The connection electrode 46 is electrically connected to an electrode disposed in the signal transmission unit 60.

Under the control of the control unit 76, the liquid ejection head 2 displaces the displacement element 48 in accordance with a drive signal supplied to the individual electrode 44 via the driver IC 62. As a driving method, so-called pulling-type driving can be used.

(Details and Operation of Ejection Unit)

Referring to FIG. 9, the ejection unit 15 of the liquid ejection head 2 will be described in detail.

The ejection unit 15 includes the ejection hole 8, the pressurizing chamber 10, the first individual flow path (first flow path) 12, the second individual flow path (second flow path) 14, and the third individual flow path (third flow path) 16. The first individual flow path 12 and the second individual flow path 14 are connected to the first common flow path 20 (fourth flow path (refer to FIG. 8)). The third individual flow path 16 is connected to the second common flow path 24 (fifth flow path (refer to FIG. 8)).

The first individual flow path 12 is connected to the pressurizing chamber body 10*a* in the first direction D1 in the pressurizing chamber 10. The second individual flow path 14 is connected to the partial flow path 10*b* in the fourth direction D4 in the pressurizing chamber 10. The third individual flow path 16 is connected to the partial flow path 10*b* in the first direction D1 in the pressurizing chamber 10.

The liquid supplied from the first individual flow path 12 flows downward in the partial flow path 10*b* through the pressurizing chamber body 10*a*, and is partially ejected from the ejection hole 8. The liquid which is not ejected from the ejection hole 8 is collected outward from the ejection unit 15 via the third individual flow path 16.

The liquid supplied from the second individual flow path 14 is partially ejected from the ejection hole 8. The liquid which is not ejected from the ejection hole 8 flows upward inside the partial flow path 10*b*, and is collected outward from the ejection unit 15 via the third individual flow path 16.

As illustrated in FIG. 9, the liquid supplied from the first individual flow path 12 flows in the pressurizing chamber body 10*a* and the partial flow path 10*b*, and is ejected from the ejection hole 8. As illustrated using a broken line, the flow of the liquid in the ejection unit in the related art uniformly and substantially linearly flows toward the ejection hole 8 from the center portion of the pressurizing chamber body 10*a*.

According to the configuration, if the liquid flows in this way, the liquid is less likely to flow in the vicinity of a region 80 located opposite to a portion to which the second individual flow path 14 is connected in the pressurizing chamber 10. For example, there is a possibility that a region where the liquid stagnates may be generated in the vicinity of the region 80.

In contrast, in the ejection unit 15, the first individual flow path 12 and the second individual flow path 14 are connected to the pressurizing chamber 10, and the liquid is supplied to the pressurizing chamber 10 from these flow paths.

Therefore, the flow of the liquid supplied from the second individual flow path 14 to the pressurizing chamber 10 can be caused to collide with the flow of the liquid supplied from the first individual flow path 12 to the ejection hole 8. In this manner, the liquid supplied from the pressurizing chamber 10 to the ejection hole 8 is less likely to uniformly and substantially linearly flow. Accordingly, a configuration can be adopted in which the region where the liquid stagnates is less likely to appear inside the pressurizing chamber 10.

That is, a position of a liquid stagnation position caused by the flow of the liquid supplied from the pressurizing chamber 10 to the ejection hole 8 is moved due to the collision with the flow of the liquid supplied from the pressurizing chamber 10 to the ejection hole 8. Therefore, a configuration can be adopted in which the region where the liquid stagnates is less likely to appear inside the pressurizing chamber 10.

The pressurizing chamber 10 has the pressurizing chamber body 10*a* and the partial flow path 10*b*. The first individual flow path 12 is connected to the pressurizing chamber body 10*a*, and the second individual flow path 14 is connected to the partial flow path 10*b*. Therefore, the first individual flow path 12 supplies the liquid so that the liquid flows in the whole pressurizing chamber 10, and due to the flow of the liquid supplied from the second individual flow path 14, the region where the liquid stagnates is less likely to appear in the partial flow path 10*b*.

The third individual flow path 16 is connected to the partial flow path 10*b*. Therefore, a configuration is adopted as follows. The flow of the liquid flowing from the second individual flow path 14 toward the third individual flow path 16 traverses the inside of the partial flow path 10*b*. As a result, the liquid flowing from the second individual flow path 14 toward the third individual flow path 16 can be caused to flow so as to traverse the flow of the liquid supplied from the pressurizing chamber body 10*a* to the ejection hole 8. Therefore, the region where the liquid stagnates is much less likely to appear inside the partial flow path 10*b*.

(Details and Operation of Individual Flow Path)

The third individual flow path 16 is connected to the partial flow path 10*b*, and is connected to the pressurizing chamber body 10*a* side from the second individual flow path 14. Therefore, even when air bubbles enter the inside of the partial flow path 10*b* from the ejection hole 8, the air bubbles can be discharged to the third individual flow path 16 by utilizing buoyancy of the air bubbles. In this manner, it is possible to reduce a possibility that the air bubbles stagnating inside the partial flow path 10*b* affect the pressure propagation to the liquid.

In a plan view, the first individual flow path 12 is connected to the pressurizing chamber body 10*a* in the first direction D1, and the second individual flow path 14 is connected to the partial flow path 10*b* in the fourth direction D4.

Therefore, in a plan view, the liquid is supplied to the ejection unit 15 from both sides in the first direction D1 and the fourth direction D4. Therefore, the supplied liquid has a velocity component in the first direction D1 and a velocity component in the fourth direction D4. Therefore, the liquid supplied to the pressurizing chamber 10 agitates the liquid inside the partial flow path 10*b*. As a result, the region where the liquid stagnates is less likely to appear inside the partial flow path 10*b*.

The third individual flow path 16 is connected to the partial flow path 10*b* in the first direction D1, and the ejection hole 8 is located in the partial flow path 10*b* in the fourth direction D4. In this manner, the liquid can also flow in the first direction D1 of the partial flow path 10*b*, and the region where the liquid stagnates is less likely to appear inside the partial flow path 10*b*.

A configuration may be adopted as follows. The third individual flow path 16 is connected to the partial flow path 10*b* in the fourth direction D4, and the ejection hole 8 is located in the partial flow path 10*b* in the first direction D1. Even in this case, the same advantageous effect can be achieved.

As illustrated in FIG. 8, the third individual flow path 16 is connected to the pressurizing chamber body 10*a* of the second common flow path 24. In this manner, the air bubbles discharged from the partial flow path 10*b* can flow along the upper surface of the second common flow path 24. In this manner, the air bubbles are likely to be discharged from the second common flow path 24 via the opening 24*a* (refer to FIG. 6).

It is preferable that the upper surface of the third individual flow path 16 and the upper surface of the second common flow path 24 are flush with each other. In this manner, the air bubbles discharged from the partial flow path 10*b* flow along the upper surface of the third individual flow path 16 and the upper surface of the second common flow path 24. Accordingly, the air bubbles are more likely to be discharged outward.

The second individual flow path 14 is connected to the ejection hole 8 of the partial flow path 10*b* from the third individual flow path 16. In this manner, the liquid is supplied from the second individual flow path 14 in the vicinity of the ejection hole 8. Therefore, the flow velocity of the liquid in the vicinity of the ejection hole 8 can be quickened, and precipitation of pigments contained in the liquid is suppressed. Therefore, the ejection hole 8 is less likely to be clogged.

As illustrated in FIG. 7B, in a plan view, the first individual flow path 12 is connected to the pressurizing chamber body 10*a* in the first direction D1, and an area centroid of the partial flow path 10*b* is located in the fourth direction D4 from the area centroid of the pressurizing chamber body 10*a*. That is, the partial flow path 10*b* is connected far from the first individual flow path 12 of the pressurizing chamber body 10*a*.

In this manner, the liquid supplied to the pressurizing chamber body 10*a* in the first direction D1 spreads to the entire region of the pressurizing chamber body 10*a*, and thereafter, is supplied to the partial flow path 10*b*. As a result, the region where the liquid stagnates is less likely to appear inside the pressurizing chamber body 10*a*.

The area centroid of a certain plane figure is a point where a centroid of an object is located inside the plane figure when a plate-shaped object whose planar shape is the same as the plane figure is made of a material having a uniform mass per unit area. The area centroid is an intersection between a first straight line and a second straight line when drawing the first straight line bisecting an area of the plane figure and the second straight line bisecting the area of the plane figure and having an angle which is different from that of the first straight line.

In a plan view, the ejection hole 8 is located between the second individual flow path 14 and the third individual flow path 16. In this manner, when the liquid is ejected from the ejection hole 8, it is possible to move a position where the flow of the liquid supplied from the pressurizing chamber body 10*a* to the ejection hole 8 and the flow of the liquid supplied from the second individual flow path 14 collide with each other.

That is, the ejection amount of the liquid supplied from the ejection hole 8 varies depending on an image to be printed. The behavior of the liquid inside the partial flow path 10*b* is changed in response to an increase or a decrease in the ejection amount of the liquid. Therefore, due to the increase or the decrease in the ejection amount of the liquid, the position where the flow of the liquid supplied from the pressurizing chamber body 10*a* to the ejection hole 8 and the flow of the liquid supplied from the second individual flow path 14 collide with each other is moved. Therefore, the region where the liquid stagnates is less likely to appear inside the partial flow path 10*b*.

The area centroid of the ejection hole 8 is located in the fourth direction D4 from the area centroid of the partial flow path 10*b*. In this manner, the liquid supplied to the partial flow path 10*b* spreads to the whole region of the partial flow path 10*b*, and thereafter, is supplied to the ejection hole 8. Therefore, the region where the liquid stagnates is less likely to appear inside the partial flow path 10*b*.

Here, the ejection unit 15 is connected to the first common flow path 20 (fourth flow path) via the first individual flow path 12 (first flow path) and the second individual flow path 14 (second flow path). Therefore, the pressure applied to the pressurizing chamber body 10*a* is partially propagated to the first common flow path 20 via the first individual flow path 12 and the second individual flow path 14.

In the first common flow path 20, if a pressure wave is propagated from the first individual flow path 12 and the second individual flow path 14 and a pressure difference is generated inside the first common flow path 20, there is a possibility that the behavior of the liquid in the first common flow path 20 may become unstable. Therefore, it is preferable that a magnitude of the pressure wave propagated to the first common flow path 20 is uniform.

In the liquid ejection head 2, in a sectional view, the second individual flow path 14 is located below the first individual flow path 12. Therefore, the distance from the pressurizing chamber body 10*a* in the second individual flow path 14 is longer than the distance from the pressurizing chamber body 10*a* in the first individual flow path 12. Accordingly, when the pressure wave is propagated to the second individual flow path 14, pressure attenuation occurs.

The flow path resistance of the second individual flow path 14 is lower than the flow path resistance of the first individual flow path 12. Accordingly, the pressure attenuation when the liquid flows in the second individual flow path 14 can be set to be smaller than the pressure attenuation when the liquid flows in the first individual flow path 12. As a result, the magnitude of the pressure wave propagated from the first individual flow path 12 and the second individual flow path 14 can be substantially uniform.

That is, the sum of the pressure attenuation from the pressurizing chamber body 10*a* to the first individual flow path 12 or to the second individual flow path 14 and the pressure attenuation when the liquid flows in the first individual flow path 12 or the second individual flow path 14 can be substantially uniform between the first individual flow path 12 and the second individual flow path 14, and the magnitude of the pressure wave propagated to the first common flow path 20 can be substantially uniform.

In a sectional view, the third individual flow path 16 is located higher than the second individual flow path 14, and is located lower than the first individual flow path 12. In other words, the third individual flow path 16 is located between the first individual flow path 12 and the second individual flow path 14. Therefore, when the pressure applied to the pressurizing chamber body 10*a* is propagated to the second individual flow path 14, a portion of the pressure is propagated to the third individual flow path 16.

In contrast, the flow path resistance of the second individual flow path 14 is lower than the flow path resistance of the first individual flow path 12. Therefore, even though the pressure wave reaching the second individual flow path 14 decreases, the pressure attenuation decreases in the second individual flow path 14. Accordingly, the magnitude of the pressure wave propagated from the first individual flow path 12 and the second individual flow path 14 can be substantially uniform.

The flow path resistance of the first individual flow path 12 can be set to 1.03 to 2.5 times the flow path resistance of the second individual flow path 14.

The flow path resistance of the second individual flow path 14 may be set to be higher than the flow path resistance of the first individual flow path 12. In this case, a configuration can be adopted in which the pressure is less likely to be propagated from the first common flow path 20 via the second individual flow path 14. As a result, it is possible to reduce a possibility that unnecessary pressure may be propagated to the ejection hole 8.

The flow path resistance of the second individual flow path 14 can be set to 1.03 to 2.5 times the flow path resistance of the first individual flow path 12.

(Connection Position between Individual Flow Path and Common Flow Path)

In the ejection unit 15, a connection position between the first individual flow path 12 and the first common flow path 20 is located in the end portion 20*c* (upstream side in another viewpoint), compared to a connection position between the second individual flow path 14 and the first common flow path 20. In the present embodiment, the end portion 20*c* is an example of a first end portion, and the end portion 20*d* is an example of a second end portion. The connection position between the first individual flow path 12 and the first common flow path 20 is located upward (opposite to a side where the ejection hole 8 is open outward), compared to the connection position between the second individual flow path 14 and the first common flow path 20.

Therefore, for example, a pressure difference can be reduced between the first individual flow path 12 and the second individual flow path 14. Specifically, the configuration is as follows.

In the first common flow path 20 which supplies the liquid to the first individual flow path 12 and the second individual flow path 14, the pressure is lowered due to a pressure loss on the downstream side. Here, the connection position between the first individual flow path 12 and the first common flow path 20 is located on the upstream side (end portion 20*c*) of the connection position between the second individual flow path 14 and the first common flow path 20. Therefore, from a viewpoint of the pressure loss in the first common flow path 20, the pressure of the second individual flow path 14 is lower than the pressure of the first individual flow path 12.

On the other hand, the pressure generated due to gravity acting on the liquid becomes higher downward (to a deeper position). The liquid ejection head 2 is generally located so that the ejection hole 8 is open downward. Here, the connection position between the first individual flow path 12 and the first common flow path 20 is located opposite to a side where the ejection hole 8 is open outward, compared to the connection position between the second individual flow path 14 and the first common flow path 20. Therefore, from a viewpoint of the gravity, the pressure applied from the first common flow path 20 to the second individual flow path 14 is higher than the pressure applied from the first common flow path 20 to the first individual flow path 12.

According to the above-described configuration, for example, the pressure difference due to the pressure loss is reduced by the pressure difference due to gravity. In another viewpoint, for example, at the connection position between the second individual flow path 14 and the first common flow path 20 which is located below the connection position between the first individual flow path 12 and the first common flow path 20, compared to a case of being connected to the first common flow path 20 on the upstream side of the connection position between the first individual flow path 12 and the first common flow path 20, the pressure difference between the first individual flow path 12 and the second individual flow path 14 is small. In the realistic dimension of the liquid ejection head 2, the pressure difference due to the gravity is smaller than the pressure difference due to the pressure loss in many cases.

Furthermore, the centroid of the first individual flow path 12 is located above the centroid of the second individual flow path 14 (opposite to a side where the ejection hole 8 is open outward). According to this configuration, the pressure applied to the pressurizing chamber 10 from the first individual flow path 12 is higher than the pressure applied to the pressurizing chamber 10 from the second individual flow path 14, and thus, the above-described advantageous effect is more highly achieved.

Furthermore, the whole first individual flow path 12 is located above the whole second individual flow path 14 (opposite to the side where the ejection hole 8 is open outward). According to this configuration, the pressure applied to the pressurizing chamber 10 from the first individual flow path 12 is higher than the pressure applied to the pressurizing chamber 10 from the second individual flow path 14, and thus, the above-described advantageous effect is more highly achieved.

Since the pressure difference is reduced in this way, for example, when the liquid ejection head 2 is filled with the liquid before the liquid ejection head 2 starts to be used and/or when the liquid ejection head 2 is used, the flow inside the pressurizing chamber 10 is optimized. Specifically, the configuration is as follows.

Immediately after the liquid ejection head 2 is manufactured, the flow paths of the first flow path member 4 and the second flow path member 6 are internally empty as a matter of course. Thereafter, at a proper time until the liquid ejection head 2 starts to be used, the liquid ejection head 2 is filled with the liquid. For example, similarly to when in use, the liquid is supplied to the opening 6*b*. As described above, the liquid supplied to the opening 6*b* is supplied to the end portion 20*c* of the first common flow path 20 via the first integrated flow path 22. The liquid supplied to the first common flow path 20 flows into the pressurizing chamber 10 via the first individual flow path 12 and the second individual flow path 14. While the gas of the pressurizing chamber 10 is discharged to the third individual flow path 16, the pressurizing chamber 10 is filled.

In this case, for example, the flow velocity inside the second individual flow path 14 is slower than the flow velocity inside the first individual flow path 12 due to the pressure difference caused by the pressure loss. As a result, for example, there is a possibility that filling the second individual flow path 14 with the liquid, filling the pressurizing chamber 10 with the liquid from the second individual flow path 14, and discharging the gas of the pressurizing chamber 10 from the second individual flow path 14 to the third individual flow path 16 may be late than filling the first individual flow path 12 with the liquid, filling the pressurizing chamber 10 with the liquid from the first individual flow path 12, and discharging the gas of the pressurizing chamber 10 from the first individual flow path 12 to the third individual flow path 16. There is a possibility that the gas may remain in the second individual flow path 14 or the pressurizing chamber 10.

For example, if the flow path resistance of the second individual flow path 14 is lower than the flow path resistance of the first individual flow path 12, the flow path having relatively low flow path resistance is not effectively used. For these reasons, there is a possibility that a time may be lengthened until the liquid ejection head 2 is in a usable state.

However, as described above, the pressure difference caused by the pressure loss is mitigated by the pressure difference (flow velocity difference) caused by the gravity, thereby reducing a possibility that there may be a disadvantage. In another viewpoint, compared to a case where the second individual flow path 14 located below the first individual flow path 12 is connected to the first common flow path 20 on the upstream side of the connection position between the first individual flow path 12 and the first common flow path 20, the time is shortened until the liquid ejection head 2 is in a usable state.

When the liquid ejection head 2 is used after being filled with the liquid, for example, the pressure difference decreases between the first individual flow path 12 and the second individual flow path 14. Accordingly, it becomes easy to adjust the flow of the liquid inside the ejection unit 15 by adjusting the shape of the flow path. For example, compared to a case where the pressure difference caused by the pressure loss is promoted by the pressure difference caused by the gravity, the pressure difference is ignored between the first individual flow path 12 and the second individual flow path 14. In this manner, a difference is reduced between a result obtained when the flow inside the ejection unit 15 is predicted and the actual flow.

In the configuration in which the pressure difference is reduced between the first individual flow path 12 and the second individual flow path 14, the first individual flow path 12 and the second individual flow path 14 serve as the flow path for supplying the liquid of the first common flow path 20 to the pressurizing chamber 10.

Therefore, it becomes easy to adjust the influence of the flow from the first individual flow path 12 to the pressurizing chamber 10 on the flow inside the pressurizing chamber 10 and the influence of the flow from the second individual flow path 14 to the pressurizing chamber 10 on the flow inside the pressurizing chamber 10 by adjusting the shape of the flow path of the first individual flow path 12 and the second individual flow path 14. Consequently, it becomes easy to reduce the stagnation inside the pressurizing chamber 10 and to adjust the ink droplets ejected from the ejection hole 8. As a result, the ink droplets can be stably ejected from the ejection hole 8.

In the configuration in which the pressure difference is reduced between the first individual flow path 12 and the second individual flow path 14, when viewed in the thickness direction (opening direction of the ejection hole 8, upward-downward direction) of the first common flow path 20, the first individual flow path 12 and the second individual flow path 14 extend from the first common flow path 20 to mutually the same side in the width direction (direction perpendicular to the first direction D1) of the first common flow path 20.

Therefore, for example, any one of the first individual flow path 12 and the second individual flow path 14 does not need to have a shape which is folded back (bent 180°) from the first common flow path 20 toward the pressurizing chamber 10, and are likely to have a simple shape of the flow path. As a result, for example, the simple shapes reduces a change in the pressure and/or the velocity of each flow in the first individual flow path 12 and the second individual flow path 14. Owing to this advantageous and the advantageous effect of reducing the pressure difference in the first individual flow path 12 and the second individual flow path 14, for example, it becomes easy to predict and/or to adjust the flow in the ejection unit 15.

In the configuration in which the pressure difference is reduced between the first individual flow path 12 and the second individual flow path 14, when viewed in the thickness direction of the first common flow path 20, the first individual flow path 12 and the second individual flow path 14 extend from the pressurizing chamber 10 to mutually opposite sides (in first direction D1 and the fourth direction D4, direction away from each other) in the flow path direction of the first common flow path 20.

Therefore, for example, the liquid of the first individual flow path 12 and the second individual flow path 14 which have the reduced pressure difference is supplied to the pressurizing chamber 10 in both the first direction D1 and the fourth direction D4. Therefore, efficiency in filling the liquid is improved. It becomes easy to predict the flow inside the pressurizing chamber 10.

In the configuration in which the pressure difference is reduced between the first individual flow path 12 and the second individual flow path 14, the connection position between the third individual flow path 16 and the pressurizing chamber 10 is located between the connection position between the pressurizing chamber 10 and the first individual flow path 12 and the connection position between the pressurizing chamber 10 and the second individual flow path 14 in the thickness direction of the first common flow path 20.

Therefore, for example, in the three individual flow paths, the first individual flow path 12 and the second individual flow path 14 are the two individual flow paths farthest from each other. Accordingly, an advantageous effect of reducing the pressure difference due to the pressure loss is improved by the pressure difference due to the gravity. For example, when the pressurizing chamber 10 is filled with the liquid from both the first individual flow path 12 and the second individual flow path 14, the third individual flow path 16 is opened between the liquids flowing from both of these. As a result, the gas inside the pressurizing chamber 10 can be efficiently discharged to the third individual flow path 16. Consequently, while the pressure difference is reduced between the first individual flow path 12 and the second individual flow path 14, an advantageous effect of shortening a liquid filling time is improved.

Second Embodiment

Figure 10A:
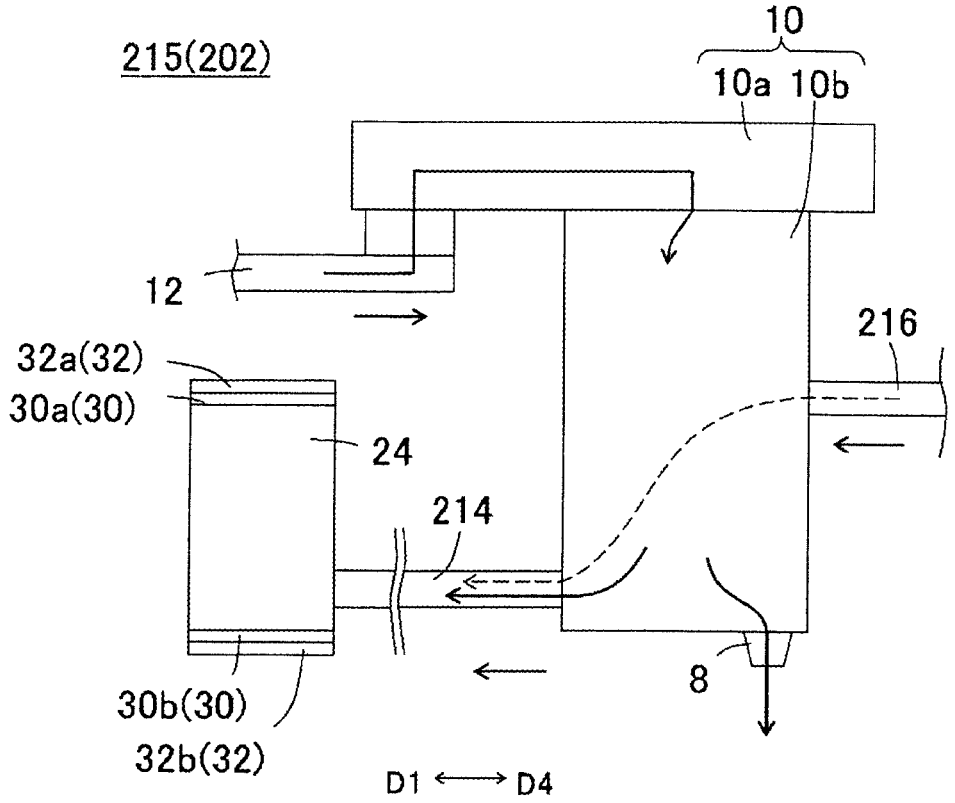
FIG. 10A is a conceptual diagram illustrating a flow of a fluid inside a liquid ejection unit.
Figure 10B:
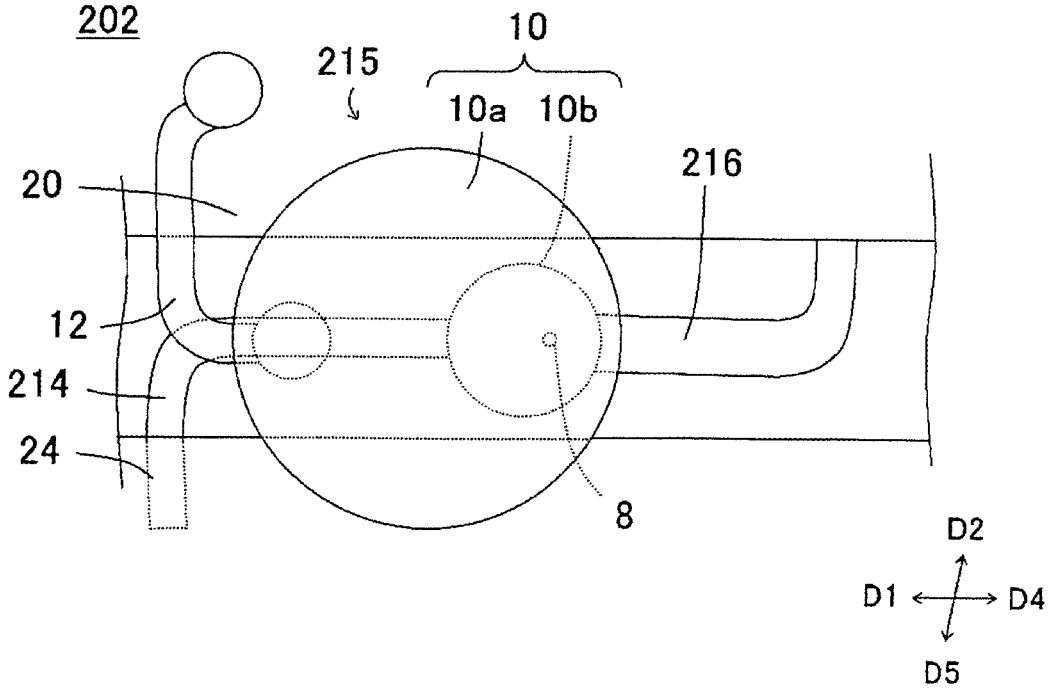
FIG. 10B is a plan view of the ejection unit.

Referring to FIG. 10, a liquid ejection head 202 according to a second embodiment will be described.

An ejection unit 215 includes the ejection hole 8, the pressurizing chamber 10, the first individual flow path (first flow path) 12, a second individual flow path (third flow path) 214, and a third individual flow path (second flow path) 216. The first individual flow path 12 and the third individual flow path 216 are connected to the first common flow path 20 (fourth flow path), and the second individual flow path 214 is connected to the second common flow path 24 (fifth flow path). Therefore, the liquid is supplied to the ejection unit 215 from the first individual flow path 12 and the third individual flow path 216, and the liquid is collected from the second individual flow path 214.

In a plan view, in the liquid ejection head 202, the first individual flow path 12 is connected to the pressurizing chamber body 10*a* in the first direction D1, and the third individual flow path 216 is connected to the partial flow path 10*b* in the fourth direction D4.

Therefore, in a plan view, in the ejection unit 215, the liquid is supplied from both sides in the first direction D1 and the fourth direction D4. Accordingly, the supplied liquid has a velocity component in the first direction D1 and a velocity component in the fourth direction D4. Therefore, the liquid supplied to the pressurizing chamber 10 agitates the liquid inside the partial flow path 10*b*. As a result, the region in which the liquid stagnates is less likely to appear inside the partial flow path 10*b*.

The second individual flow path 214 is connected to the partial flow path 10*b* in the first direction D1, and the third individual flow path 216 is connected to the partial flow path 10*b* in the fourth direction D4. Therefore, the liquid supplied from the third individual flow path 216 flows in the first direction D1 from the fourth direction D4 so as to internally traverse the partial flow path 10*b*. As a result, the region where the liquid stagnates is less likely to appear inside the partial flow path 10*b*.

The ejection hole 8 is connected to the lower end of the partial flow path 10*b*, and the second individual flow path 214 is connected to a position higher than the lower end of the partial flow path 10*b*. Therefore, the second individual flow path 214 and the lower end of the partial flow path 10*b* are separated from each other. As a result, even if the pressure wave generated inside the second common flow path 24 is propagated into the partial flow path 10*b* through the second individual flow path 214, since there is a distance between the second individual flow path 214 and the ejection hole 8, the pressure wave is less likely to be propagated to the ejection hole 8. Therefore, a configuration can be adopted in which the pressure wave generated inside the second common flow path 24 is less likely to be propagated to the ejection hole 8 through the second individual flow path 214.

The lower end of the partial flow path 10*b* is a portion connected to the ejection hole 8 in the partial flow path 10*b*, and is a portion formed in the plate 4*l* adjacent to the plate 4*m* where the ejection hole 8 is formed in the partial flow path 10*b*.

The connection position between the first individual flow path 12 and the first common flow path 20 is located in the end portion 20*c* (first direction D1, upstream side), compared to the connection position between the third individual flow path 216 and the first common flow path 20. In the present embodiment, the end portion 20*c* is an example of a first end portion, and the end portion 20*d* is an example of a second end portion. The connection position between the first individual flow path 12 and the first common flow path 20 is located above (opposite to a side where the ejection hole 8 is open outward) the connection position between the third individual flow path 216 and the first common flow path 20.

Therefore, for example, similarly to the first embodiment, in the first individual flow path 12 and the third individual flow path 216, the pressure difference due to the pressure loss is reduced by the pressure difference due to the gravity. As a result, for example, the following advantageous effect can be achieved. The liquid filling time before use can be shortened and/or it becomes easy to adjust the flow inside the pressurizing chamber 10 when in use.

Third Embodiment

Figure 11A:
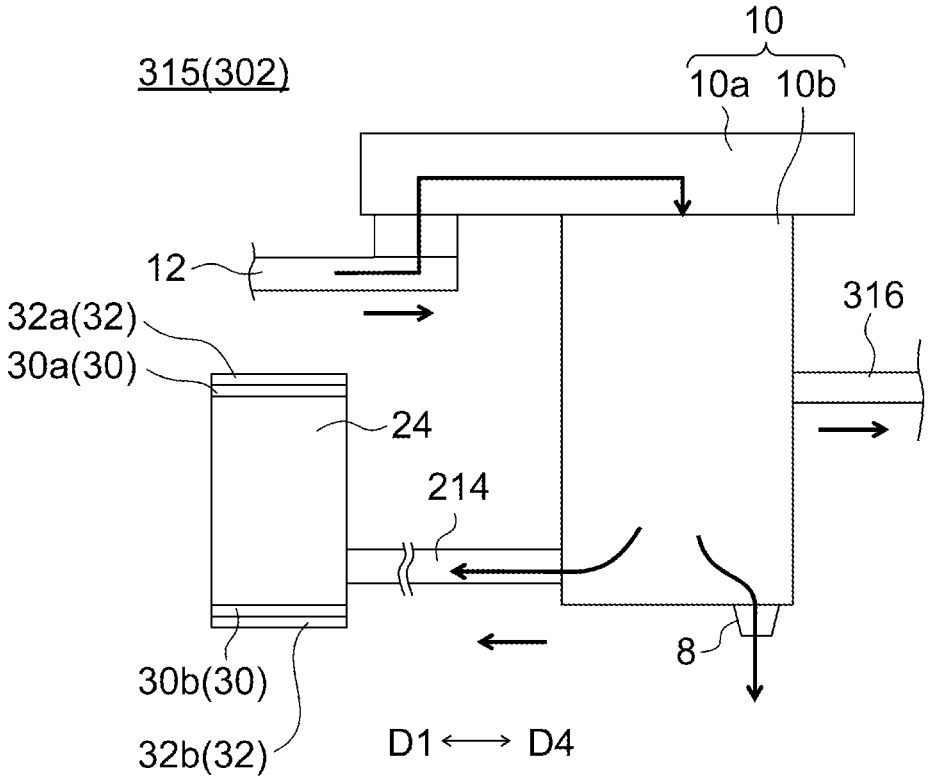
FIG. 11A is a conceptual diagram illustrating a flow of a fluid inside a liquid ejection unit.
Figure 11B:
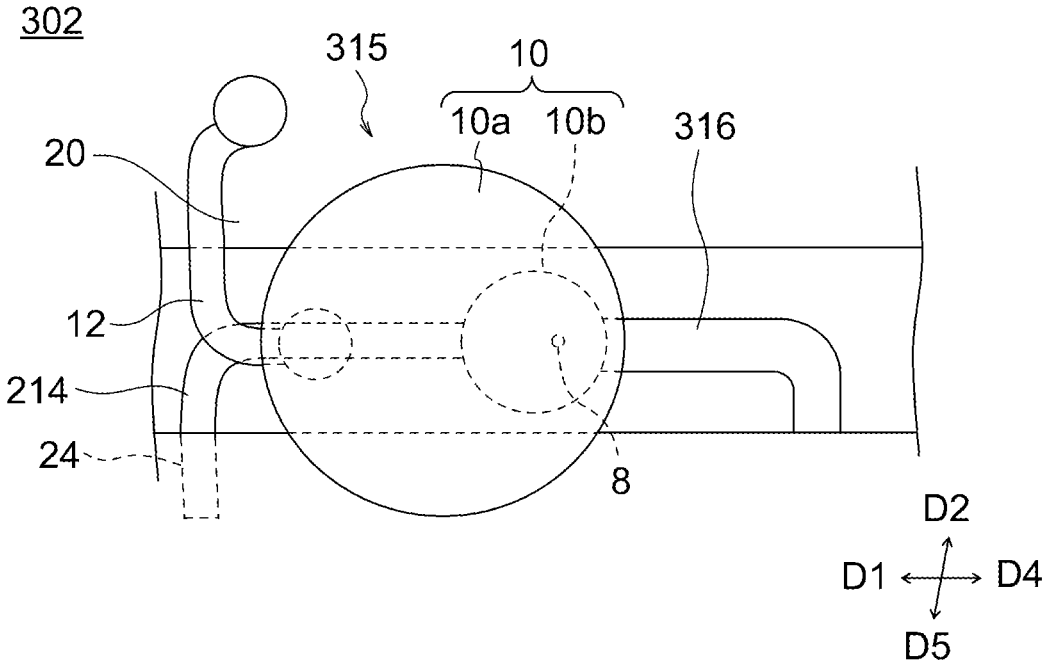
FIG. 11B is a plan view of the ejection unit.

Referring to FIG. 11, a liquid ejection head 302 according to a third embodiment will be described.

An ejection unit 315 includes the ejection hole 8, the pressurizing chamber 10, the first individual flow path (third flow path) 12, the second individual flow path (second flow path) 214, and a third individual flow path (first flow path) 316. The first individual flow path 12 is connected to the first common flow path 20 (fifth flow path), and the second individual flow path 214 and the third individual flow path 316 are connected to the second common flow path 24 (fourth flow path). Therefore, the liquid is supplied to the ejection unit 315 from the first individual flow path 12, and the liquid is collected from the second individual flow path 214 and the third individual flow path 316.

In a plan view, in the liquid ejection head 302, the second individual flow path 214 is connected to the pressurizing chamber body 10*a* in the first direction D1, and the third individual flow path 316 is connected to the partial flow path 10*b* in the fourth direction D4.

Therefore, in a plan view, in the ejection unit 315, the liquid is collected from both sides in the first direction D1 and the fourth direction D4. Accordingly, the liquid inside the pressurizing chamber 10 has a velocity component in the first direction D1 and a velocity component in the fourth direction D4. Therefore, the liquid supplied to the pressurizing chamber 10 agitates the liquid inside the partial flow path 10*b*. As a result, the region in which the liquid stagnates is less likely to appear inside the partial flow path 10*b*.

The connection position between the third individual flow path 316 and the second common flow path 24 is located in the end portion 24*c* (fourth direction D4), compared to the connection position between the second individual flow path 214 and the second common flow path 24. In the present embodiment, the end portion 24*c* is an example of a first end portion, and the end portion 24*d* is an example of a second end portion. The connection position between the third individual flow path 316 and the second common flow path 24 is located above (opposite to a side where the ejection hole 8 is open outward) the connection position between the second individual flow path 214 and the second common flow path 24.

Here, when the liquid ejection head 302 is used, the end portion 24*c* of the second common flow path 24 is located on the downstream side of the second common flow path 24. However, when the liquid ejection head 302 is filled with the liquid before use, the procedure when in use may be reversed as follows. The liquid may be supplied to the opening 6*c*. In this manner, the liquid may be supplied from the third individual flow path 316 and the second individual flow path 214 to the pressurizing chamber 10. The gas inside the pressurizing chamber 10 may be discharged from the first individual flow path 12. In this case, the end portion 24*c* is located on the upstream side in the second common flow path 24. Therefore, similar to the first embodiment, in the second individual flow path 214 and the third individual flow path 316, the pressure difference due to the pressure loss is reduced by the pressure difference due to the gravity.

When the liquid ejection head 302 is used, the third individual flow path 316 is connected to the downstream side of the second individual flow path 214. From this viewpoint, the liquid of the pressurizing chamber 10 is more likely to flow to the third individual flow path 316 than the second individual flow path 214. On the other hand, the second individual flow path 214 is located below the third individual flow path 316. Accordingly, from this viewpoint, the liquid of the pressurizing chamber 10 is more likely to flow to the second individual flow path 214 than the third individual flow path 316. Therefore, for example, a biased flow of the liquid in the pressurizing chamber 10 is reduced.

In the above-described embodiment, the displacement element 48 is an example of the pressurizing unit. The transport rollers 74*a* to 74*d* are examples of the transport unit.

Aspects of this disclosure are not limited to the above-described embodiments, and various modifications are available without departing from the gist of the disclosure.

The configuration of the flow path connected to the pressurizing chamber in order to supply or collect the liquid is not limited to the examples described in the embodiments. For example, in FIG. 9, the third individual flow path 16 may be connected to the side surface of the partial flow path 10*b* in the fourth direction D4. In FIG. 10, the second individual flow path 214 may be connected to the side surface of the partial flow path 10*b* in the fourth direction D4. In FIG. 11, a relative position relationship among the ejection hole 8, the pressurizing chamber 10, and the first individual flow path 12 in the first direction D1 may be revered to the illustrated relationship in FIG. 11. In the embodiments, as an example, the first individual flow path 12 is used only for supplying the liquid, but may be used for collecting the liquid.

In the embodiment, in a plan view, the width (direction perpendicular to the first direction D1) of the individual flow path (for example, the second individual flow path 14 and the third individual flow path 16) connected to the partial flow path 10*b* is set to be smaller than the diameter of the partial flow path 10*b*. However, the width of the individual flow paths may be set to be equal to or larger than the diameter of the partial flow path 10*b* by widening the portion connected to the partial flow path 10*b*.

In a plan view, the first flow path and the second flow path which are pulled out from the fourth flow path (for example, the first individual flow path 12 and the second individual flow path 14 which are pulled out from the first common flow path 20) may not extend from the fourth flow path to mutually the same side in the width direction of the fourth flow path. For example, the central portion of the pressurizing chamber body 10*a* may overlap the fourth flow path. The partial flow path 10*b* may be located on one side of the fourth flow path. The first flow path may extend from the fourth flow path to the other side of the fourth flow path, and may be connected to a portion located on the other side of the pressurizing chamber body 10*a*. The second flow path may extend from the fourth flow path to the one side, and may be connected to the partial flow path 10*b*.

In a plan view, the first flow path and the second flow path may not extend from the pressurizing chamber to mutually opposite sides in the flow path direction of the fourth flow path. In another viewpoint, the whole first flow path may not be located on a side of the first end portion which is open in the fourth flow path, compared to the whole second flow path. For example, the first flow path and the second flow path may extend from the pressurizing chamber to mutually the same side in the flow path direction of the fourth flow path. The connection position between the first flow path and the fourth flow path may be located on the side of the first end portion, compared to the connection position between the second flow path and the fourth flow path.

In the embodiment, the end portion 20*d* of the first common flow path 20 or the end portion 24*d* of the second common flow path 24, which is an example of the second end portion of the fourth flow path, is completely closed. However, the second end portion may open using the opening area which is smaller than the opening area of the first end portion (the end portion 20*c* or the end portion 24*c*).

For example, a connection path substantially extending in the width direction of the first common flow path 20 from the end portion 20*d* and connected to the second common flow path 24 and/or a connection path substantially extending in the width direction of the second common flow path 24 from the end portion 24*d* and connected to the first common flow path 20 may be disposed therein. Since the connection path is disposed in this way, for example, it is possible to reduce a possibility that the liquid may stagnate in the end portion 20*d* and/or the end portion 24*d*. For example, the cross-sectional area of the connection path (cross-sectional area perpendicular to the flow path direction) is smaller than the cross-sectional area of the common flow path. Consequently, the opening area in the second end portion is smaller than the opening area in the first end portion.

The opening area of the end portion is basically an area of the opening on the inner surface (upper surface, lower surface, inner wall and/or end surface) of the fourth flow path. For example, in the end portion 24*c* and the end portion 24*c*, the opening area is an area of the opening 20*a* or the opening 24*a*. With regard to the above-described connection path, the opening area is an area in which the connection path is open on the inner surface of the fourth flow path. When a plurality of connection paths is connected to one end portion, the opening area is the sum of the opening areas. However, for example, when the cross-sectional area of the connection path is enlarged at the connection position between the connection path and the fourth flow path in view of the liquid flowing, the minimum cross-sectional area of the connection path may be set as the opening area.

In the embodiment, as illustrated in FIG. 6, except that orientations of the adjacent ejection unit columns are opposite to each other in the second direction D2, all of the ejection units have the same relative position relationship among the first to fifth flow paths. For example, the following configuration satisfies all of the ejection units. In the first flow path and the second flow path (for example, the first individual flow path 12 and the second individual flow path 14) which are connected to the same pressurizing chamber, the connection position between the first flow path and the fourth flow path is located on the side of the first end portion (end portion 20*c*), compared to the connection position between the second flow path and the fourth flow path, and the first flow path is located opposite to the side where the ejection hole is open outward, compared to the second flow path. However, the configuration described as an example in the embodiments may not necessarily satisfy all of the ejection units. For example, the orientations of the adjacent ejection unit columns may be reversed to each other in the first direction D1. Even in this case, for example, compared to a case where the pressure difference due to the pressure loss is superimposed on the pressure difference due to the gravity are superimposed in all of the ejection units, the pressure difference due to the pressure loss is reduced by the pressure difference due to the gravity in at least some of the ejection units. This reduces a possibility that air bubbles may remain in any one of the ejection units inside the liquid ejection head after the liquid ejection head is filled with the liquid before use.

REFERENCE SIGNS LIST

1 color inkjet printer
2 liquid ejection head
2*a* head body
4 first flow path member
4*a* to 4*m* plate
4-1 pressurizing chamber surface
4-2 ejection hole surface
6 second flow path member
8 ejection hole
10 pressurizing chamber
10*a* pressurizing chamber body
10*b* partial flow path
12 first individual flow path (first flow path or third flow path)
14 second individual flow path (second flow path)
15 ejection unit
16 third individual flow path (third flow path)
20 first common flow path (fourth flow path or fifth flow path)
22 first integrated flow path
24 second common flow path (fifth flow path or fourth flow path)
26 second integrated flow path
28 end portion flow path
30 damper
32 damper chamber
40 piezoelectric actuator board
42 common electrode
44 individual electrode
46 connection electrode
48 displacement element (pressurizing unit)
50 housing
52 heat sink
54 wiring board
56 pressing member
58 elastic member
60 signal transmission unit
62 driver IC
70 head mounting frame
72 head group
74*a*, 74*b*, 74*c*, 74*d* transport roller
76 control unit
P recording medium
D1 first direction
D2 second direction
D3 third direction
D4 fourth direction
D5 fifth direction
D6 sixth direction

The invention claimed is:

1. A liquid ejection head comprising:

a flow path member comprising
- a plurality of ejection holes,
- a plurality of pressurizing chambers respectively connected to the plurality of ejection holes,
- a plurality of first flow paths respectively connected to the plurality of pressurizing chambers,
- a plurality of second flow paths respectively connected to the plurality of pressurizing chambers,
- a plurality of third flow paths respectively connected to the plurality of pressurizing chambers,
- a fourth flow path that extends in a direction perpendicular to an opening direction of the plurality of ejection holes from a first end portion which is open to a second end portion, the second end portion being closed or whose opening area is smaller than an opening area of the first end portion, and that is connected in common to the plurality of first flow paths and the plurality of second flow paths between the first end portion and the second end portion, and
- a fifth flow path that is connected in common to the plurality of third flow paths; and a plurality of pressurizing units respectively pressurizing a liquid inside the plurality of pressurizing chambers, wherein in one of the plurality of first flow paths and one of the plurality of second flow paths which are connected to an identical one of the plurality of pressurizing chambers, a connection position between the one of the plurality of first flow paths and the fourth flow path is located on a side of the first end portion, compared to a connection position between the one of the plurality of second flow paths and the fourth flow path, and the connection position between the one of the plurality of first flow paths and the fourth flow path is located opposite to a side where the ejection hole is open outward, compared to the connection position between the one of the plurality of second flow paths and the fourth flow path.

2. The liquid ejection head according to claim 1, wherein the plurality of first flow paths and the plurality of second flow paths are flow paths for supplying the liquid of the fourth flow path to the plurality of pressurizing chambers, and the plurality of third flow paths is a flow path for collecting the liquid of the plurality of pressurizing chambers to the fifth flow path.

3. The liquid ejection head according to claim 1, wherein the plurality of first flow paths and the plurality of second flow paths are flow paths for collecting the liquid of the plurality of pressurizing chambers to the fourth flow path, and the plurality of third flow paths is a flow path for supplying the liquid of the fifth flow path to the plurality of pressurizing chambers.

4. The liquid ejection head according to claim 1, wherein the one of the plurality of first flow paths and the one of the plurality of second flow paths which are connected to the identical one of the plurality of pressurizing chambers extend from the fourth flow path to an identical side in a width direction of the fourth flow path, when viewed in the opening direction.

5. The liquid ejection head according to claim 1, wherein the one of the plurality of first flow paths and the one of the plurality of second flow paths which are connected to the identical one of the plurality of pressurizing chambers extend from the identical one of the plurality of pressurizing chambers to mutually opposite sides in a flow path direction of the fourth flow path, when viewed in the opening direction.

6. The liquid ejection head according to claim 1, wherein a connection position between one of the plurality of third flow paths and the identical one of the plurality of pressurizing chambers is located between the connection position between the one of the plurality of first flow paths and the identical one of the plurality of pressurizing chambers and the connection position between the one of the plurality of second flow paths and the identical one of the plurality of pressurizing chambers in the opening direction.

7. A recording apparatus comprising:

the liquid ejection head according to claim 1;

a transport unit that transports a recording medium to the liquid ejection head; and a control unit that controls the liquid ejection head.

8. A liquid ejection head comprising:

a flow path member comprising a plurality of ejection holes, a plurality of pressurizing chambers respectively connected to the plurality of ejection holes, a plurality of first flow paths respectively connected to the plurality of pressurizing chambers, a plurality of second flow paths respectively connected to the plurality of pressurizing chambers, a plurality of third flow paths respectively connected to the plurality of pressurizing chambers;

a fourth flow path connected in common to the plurality of first flow paths and the plurality of second flow paths, and a fifth flow path connected in common to the plurality of third flow paths; and a plurality of pressurizing units for respectively pressurizing a liquid inside the plurality of pressurizing chambers, wherein in one of the plurality of first flow paths and one of the plurality of second flow paths which are connected to an identical one of the plurality of pressurizing chambers, a connection position between the one of the plurality of first flow paths and the fourth flow path is located upstream in a flowing direction of the liquid of the fourth flow path, compared to a connection position between the one of the plurality of second flow paths and the fourth flow path, and the connection position between the one of the plurality of first flow paths and the fourth flow path is located opposite to a side where the ejection hole is open outward, compared to the connection position between the one of the plurality of second flow paths and the fourth flow path.

* * * * *